US009069289B2

(12) United States Patent
Batori et al.

(10) Patent No.: US 9,069,289 B2
(45) Date of Patent: Jun. 30, 2015

(54) DEVELOPER CONTAINER, DEVELOPING CARTRIDGE, PROCESS CARTRIDGE AND IMAGE FORMING APPARATUS

(71) Applicant: CANON KABUSHIKI KAISHA, Tokyo (JP)

(72) Inventors: Yoshiyuki Batori, Hiratsuka (JP); Toshiaki Takeuchi, Susono (JP); Ryuta Murakami, Suntou-gun (JP); Daisuke Makiguchi, Izunokuni (JP); Junichi Matsumura, Numazu (JP); Tatsuo Fujisaki, Yokohama (JP); Kazuki Matsumoto, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/314,638

(22) Filed: Jun. 25, 2014

(65) Prior Publication Data

US 2015/0003865 A1 Jan. 1, 2015

(30) Foreign Application Priority Data

Jun. 27, 2013 (JP) ..... 2013-135125

(51) Int. Cl.
*G03G 15/08* (2006.01)
*G03G 21/16* (2006.01)

(52) U.S. Cl.
CPC ..... *G03G 15/0882* (2013.01); *G03G 21/1676* (2013.01); *G03G 15/0898* (2013.01); *G03G 15/0868* (2013.01); *G03G 15/0874* (2013.01); *G03G 2215/0875* (2013.01); *G03G 2215/0682* (2013.01); *G03G 2215/0687* (2013.01)

(58) Field of Classification Search
CPC ..... G03G 15/0841; G03G 15/0868; G03G 15/0874; G03G 15/0882; G03G 15/0898; G03G 21/1676; G03G 2215/0682; G03G 2215/0687; G03G 2215/0875
See application file for complete search history.

(56) References Cited

U.S. PATENT DOCUMENTS

| | | | | |
|---|---|---|---|---|
| 4,998,140 | A * | 3/1991 | Satou et al. | 399/105 |
| 5,264,901 | A * | 11/1993 | Rossiter | 399/105 |
| 5,911,096 | A | 6/1999 | Batori et al. | |
| 5,920,753 | A | 7/1999 | Sasaki et al. | |
| 5,930,562 | A | 7/1999 | Noda et al. | |
| 5,937,237 | A | 8/1999 | Nonaka et al. | |
| 5,940,658 | A | 8/1999 | Yokoi et al. | |

(Continued)

FOREIGN PATENT DOCUMENTS

JP H05-197288 8/1993

*Primary Examiner* — Ryan Walsh
(74) *Attorney, Agent, or Firm* — Fitzpatrick, Cella, Harper & Scinto

(57) ABSTRACT

A developer container includes: a developer accommodating chamber, provided with an opening, for accommodating a developer; a sealing member including end portion sealing portions each for sealing an end portion of the opening and a central portion sealing portion for sealing a central portion of the opening; and a rotatable member, connected with the sealing member, for peeling off the sealing member from the opening by rotation thereof to expose the opening. With respect to a rotational axis direction of the rotatable member, an outer configuration of the rotatable member is different between a sealing-member-connected end thereof and a sealing-member-connected center thereof so that one of the end portion sealing portions is peeled earlier than the central portion sealing portion and so that the central portion is peeled earlier than the other one of the end portion sealing portions.

19 Claims, 18 Drawing Sheets

(56) References Cited

U.S. PATENT DOCUMENTS

| | | | |
|---|---|---|---|
| 6,075,957 | A | 6/2000 | Batori et al. |
| 6,101,348 | A | 8/2000 | Nonaka et al. |
| 6,131,007 | A | 10/2000 | Yamaguchi et al. |
| 6,275,668 | B1 | 8/2001 | Batori |
| 6,334,035 | B1 | 12/2001 | Abe et al. |
| 6,363,226 | B1 | 3/2002 | Batori |
| 6,714,746 | B2 | 3/2004 | Morioka et al. |
| 6,735,405 | B2 | 5/2004 | Yokoi et al. |
| 6,836,639 | B2 | 12/2004 | Karakama et al. |
| 6,898,392 | B2 | 5/2005 | Karakama et al. |
| 6,937,832 | B2 | 8/2005 | Sato et al. |
| 6,963,706 | B2 | 11/2005 | Morioka et al. |
| 6,987,938 | B2 | 1/2006 | Murakami et al. |
| 7,024,131 | B2 | 4/2006 | Komatsu et al. |
| 7,079,787 | B2 | 7/2006 | Ogino et al. |
| 7,127,192 | B2 | 10/2006 | Batori et al. |
| 7,136,604 | B2 | 11/2006 | Chadani et al. |
| 7,156,797 | B2 | 1/2007 | Komatsu et al. |
| 7,200,349 | B2 | 4/2007 | Sato et al. |
| 7,206,534 | B2 | 4/2007 | Murakami |
| 7,418,225 | B2 | 8/2008 | Morioka et al. |
| 7,885,575 | B2 | 2/2011 | Batori et al. |
| 8,081,898 | B2 | 12/2011 | Batori et al. |
| 8,326,185 | B2 | 12/2012 | Asanuma et al. |
| 8,406,656 | B2 | 3/2013 | Batori et al. |
| 8,565,640 | B2 | 10/2013 | Batori et al. |
| 8,620,181 | B2 | 12/2013 | Murakami |
| 8,644,732 | B2 | 2/2014 | Kikuchi et al. |
| 8,676,085 | B1 | 3/2014 | Batori et al. |
| 2001/0033756 | A1* | 10/2001 | Shiratori et al. ..... 399/103 |
| 2011/0020031 | A1 | 1/2011 | Sato et al. |
| 2011/0170906 | A1 | 7/2011 | Matsushita et al. |
| 2013/0136489 | A1 | 5/2013 | Yamaguchi et al. |
| 2013/0164039 | A1 | 6/2013 | Matsushita et al. |
| 2013/0336679 | A1 | 12/2013 | Furutani et al. |
| 2013/0343785 | A1 | 12/2013 | Matsuzaki et al. |
| 2014/0016961 | A1 | 1/2014 | Yasui et al. |
| 2014/0029974 | A1 | 1/2014 | Uesugi et al. |
| 2014/0064793 | A1 | 3/2014 | Matsuzaki et al. |
| 2014/0072331 | A1 | 3/2014 | Matsushita et al. |
| 2014/0072345 | A1 | 3/2014 | Matsunaga et al. |
| 2014/0072347 | A1 | 3/2014 | Furutani et al. |
| 2014/0079432 | A1 | 3/2014 | Matsuzaki et al. |
| 2014/0086620 | A1 | 3/2014 | Takeuchi et al. |
| 2014/0086621 | A1 | 3/2014 | Makiguchi et al. |
| 2014/0086632 | A1 | 3/2014 | Batori et al. |
| 2014/0093272 | A1 | 4/2014 | Matsumaru et al. |
| 2014/0105639 | A1 | 4/2014 | Kikuchi et al. |
| 2014/0126928 | A1 | 5/2014 | Batori et al. |
| 2014/0199092 | A1 | 7/2014 | Matsushita et al. |
| 2014/0212166 | A1 | 7/2014 | Takeuchi et al. |
| 2014/0212181 | A1 | 7/2014 | Nakamura et al. |
| 2014/0356020 | A1 | 12/2014 | Murakami et al. |
| 2014/0358535 | A1 | 12/2014 | Lee et al. |
| 2014/0363196 | A1 | 12/2014 | Wada et al. |
| 2014/0376955 | A1 | 12/2014 | Takeuchi |
| 2014/0376969 | A1 | 12/2014 | Batori |

* cited by examiner (a)

(b)

(c)

(a)

(b)

(c)

(d)

(a)

(b)

DEVELOPER CONTAINER, DEVELOPING CARTRIDGE, PROCESS CARTRIDGE AND IMAGE FORMING APPARATUS

FIELD OF THE INVENTION AND RELATED ART

The present invention relates to a developer container, a process cartridge and an image forming apparatus.

The image forming apparatus of an electrophotographic type forms an electrostatic latent image on a photosensitive member as an image bearing member by charging and exposure, and the electrostatic latent image is developed into a toner image with a toner as a developer, and then the toner image is transferred onto a recording material (medium), so that an image is formed no the recording material. Examples of the image forming apparatus include an image forming apparatus of a cartridge type for meeting replacement (exchange) of constituent members different in lifetime and meeting supply of consumables such as the toner. For example, as the cartridge, a developing cartridge prepared by integrally assembling a toner container, in which the toner is accommodated, with a developing roller and a process cartridge prepared by integrally assembling, in addition to the toner container and the developing roller, a photosensitive member, a charging means, a cleaning means and the like have been known. In such a cartridge, in order to prevent toner leakage during transportation or during the replacement, an opening of the toner container accommodating the toner is sealed in general with a seal member.

Japanese Laid-Open Patent Application (JP-A) Hei5-197288 proposes a constitution in which an end portion of the seal member for blocking a toner supply opening is mounted on a rotatable member such as a stirring member, and the seal member is, after the cartridge is mounted, wound up around the stirring member (rotatable member) by rotating the stirring member to unseal (expose) the toner supply opening. According to this constitution, a user is not required to remove the seal member, and the seal member is rotated integrally with the stirring member after the removal of the seal member, and therefore there is no need to remove the seal member from the inside of the cartridge. Accordingly, the user is not required to dispose of the seal member, so that usability is improved.

However, in the case where a force required for peeling off the seal member from the toner supply opening by the stirring member is larger than a rotational torque during a normal stirring operation of the stirring member, there is a need, in some cases, to correspondingly increase capacity of a power source or correspondingly ensure part (element) strength of a driving system. As a result, there is a possibility of occurrences of upsizing and an increase in cost of the image forming apparatus.

SUMMARY OF THE INVENTION

A principal object of the present invention is to provide a developer container capable of reducing a peeling-off load of a seal member by a rotatable member.

According to an aspect of the present invention, there is provided a developer container comprising: a developer accommodating chamber, provided with an opening, for accommodating a developer; a sealing member including end portion sealing portions each for sealing an end portion of the opening and a central portion sealing portion for sealing a central portion of the opening; and a rotatable member, connected with the sealing member, for peeling off the sealing member from the opening by rotation thereof to expose the opening, wherein with respect to a rotational axis direction of the rotatable member, an outer configuration of the rotatable member is different between a sealing-member-connected end thereof and a sealing-member-connected center thereof so that one of the end portion sealing portions is peeled earlier than the central portion sealing portion and so that the central portion is peeled earlier than the other one of the end portion sealing portions.

According to another aspect of the present invention, there is provided a developer container comprising: a developer accommodating chamber, provided with an opening, for accommodating a developer; a sealing member bonded to the developer accommodating container so as to close the opening; and a rotatable member, to which the sealing member is connected, capable of winding up the seal member by peeling off the sealing member from a bonding portion to the developer container by rotation thereof, wherein the rotatable member is constituted so that in a range from an end side to the other end side of a connecting portion to the sealing member with respect to the rotational axis direction, timing from start of winding-up of the sealing member until the sealing member is in a tension state between the rotatable member and the bonding portion is slower with an increasing distance from the end side and so that a speed of an increase in peeling-off amount of the sealing member after the sealing member is in the tension state is slower with an increasing distance from the end side.

According to another aspect of the present invention, there is provided a developing cartridge detachably mountable to a main assembly of an image forming apparatus, comprising: the developer container described above; a developer carrying member for carrying the developer; and a developer supply chamber, in which the developer carrying member is provided, communicating with the developer accommodating chamber via the opening.

According to another aspect of the present invention, there is provided a process cartridge detachably mountable to a main assembly of an image forming apparatus, comprising: the developer container described above; a developer carrying member for carrying the developer; and a developer supply chamber, in which the developer carrying member is provided, communicating with the developer accommodating chamber via the opening.

According to a further aspect of the present invention, there is provided an image forming apparatus for forming an image with a developer on a recording material; comprising: the developer container described above; a developer carrying member for carrying the developer; and a developer supply chamber, in which the developer carrying member is provided, communicating with the developer accommodating chamber via the opening.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments for carrying out the present invention will be specifically described with reference to the drawings. Dimensions, materials, shapes and relative arrangement of constituent elements described in the following embodiment should be appropriately be changed depending on structures and various conditions of devices (apparatuses) to which the present invention is applied. Accordingly, the scope of the present invention is not intended to be limited to the following embodiments.

Here, an electrophotographic image forming apparatus forms an image with a developer (toner) on a recording material by using an electrophotographic image forming process. For example, the image forming apparatus may include an electrophotographic copying machine, an electrophotographic printer (LED printer, laser beam printer or the like), an electrophotographic facsimile machine, an electrophotographic word processor, a multi-function machine (printer) having functions of these machines, and the like. Further, the recording material is a medium on which the image is to be formed, and is, e.g., a recording sheet, an OHP sheet, etc.

Further, a process cartridge is prepared by integrally assembling an electrophotographic photosensitive drum with, as a process means actable on the photosensitive drum, at least one of a charging device, a developing means and a cleaning means into a cartridge. Further, this process cartridge is constituted so as to be detachably mountable to an image forming apparatus main assembly.

(Embodiment 1)

(General Structure of Image Forming Apparatus)

Figure 2:
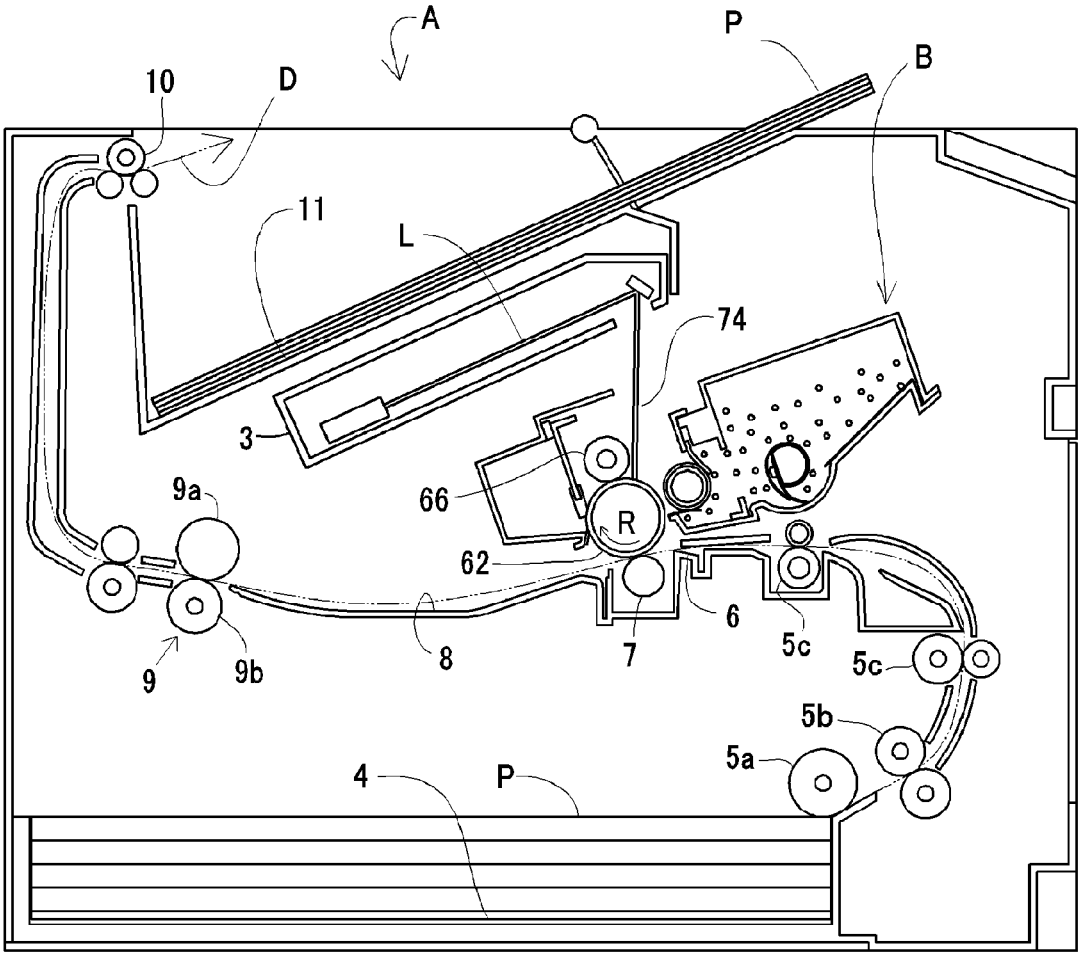
FIG. 2 is a sectional view of an image forming apparatus according to Embodiment 1.
Figure 3:
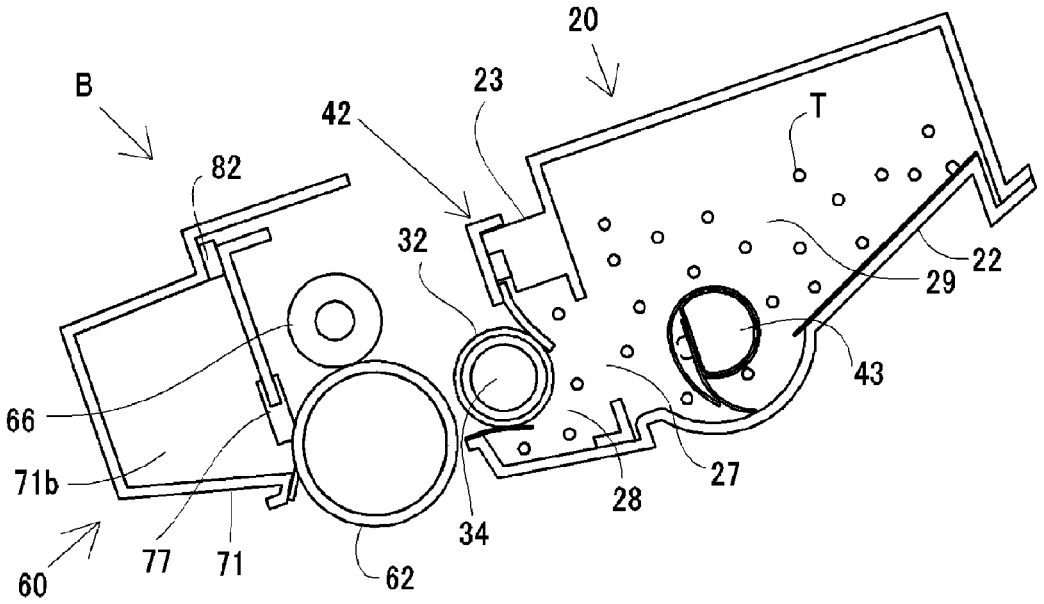
FIG. 3 is a sectional view of a process cartridge according to Embodiment 1.

With reference to FIGS. 2 and 3, a general structure of an image forming apparatus in this embodiment of the present invention will be described. FIG. 2 is a schematic sectional view showing a structure of the image forming apparatus in this embodiment. FIG. 3 is a schematic sectional view showing a structure of a process cartridge in this embodiment.

In the following description, a rotational axis direction of an electrophotographic photosensitive drum is referred to as a longitudinal direction. Further, with respect to the longitudinal direction, a side where the electrophotographic photosensitive drum receives a driving force from the main assembly of the image forming apparatus is referred to as a driving side (a driving force receiving portion 63*a* side shown in FIG. 6), and its opposite side is referred to as a non-driving side.

The image forming apparatus shown in FIG. 2 is a laser beam printer using an electrophotographic technique in which a process cartridge B is detachably mountable to an apparatus main assembly of the image forming apparatus. Here, the apparatus main assembly A of the image forming apparatus refers to a portion of the electrophotographic image forming apparatus from which the process cartridge B is removed.

In a state in which the cartridge B is mounted in the apparatus main assembly A, above the process cartridge B, an exposure device 3 (laser scanner unit) is provided. Further, below the cartridge B, a sheet (feeding) tray 4 in which a recording medium (sheet material P) as a recording material to be subjected to image formation is accommodated is provided.

Further, in the apparatus main assembly A, along a conveyance (feeding) direction D of the sheet material P, a pick-up roller 5*a*, a feeding roller pair 5*b*, a conveying roller pair 5*c*, a transfer guide 6, a transfer roller 7, a conveying guide 8, a fixing device 9, a discharging roller pair 10, a discharge tray 11 and the like are successively provided. Incidentally, the fixing device 9 is constituted by a heating roller 9*a* and a pressing roller 9*b*.

[Image Forming Process]

As shown in FIG. 2, on the basis of a print start signal, an electrophotographic photosensitive drum 62 is rotationally driven at a predetermined peripheral speed (process speed) in an arrow R direction in FIG. 2. A charging roller 66 to which an unshown charging bias voltage is applied contacts the outer peripheral surface of the drum 62 and electrically charges the outer peripheral surface of the drum 62 uniformly. The exposure device 3 outputs laser light 3*a* depending on image information. The laser light L passes through an exposure window portion 74 provided at an upper surface of the cartridge B, so that the outer peripheral surface of the drum 62 is subjected to scanning exposure. As a result, on the outer peripheral surface of the drum 62, an electrostatic latent image depending on the image information is formed.

As shown in FIG. 3, in a developing device unit 20 as a developing device, a toner T as a developer in a toner chamber 29 as a developer accommodating chamber is stirred and fed by rotation of a feeding member 43, so that the toner T is sent to a toner supply chamber 28 as a developer supply chamber. The toner T is carried on a surface of a developing roller 32 as a developer carrying member by a magnetic force of a magnet roller 34 (fixed magnet). The toner T is regulated in layer thickness on a peripheral surface of the developing roller 32 by a developing blade 42 while being triboelectrically charged. The toner T is transferred onto the drum 62 depending on the electrostatic latent image, so that the electrostatic latent image is visualized (developed) as a toner image (developer member).

As shown in FIG. 3, in synchronism with output timing of the laser light L, by the pick-up roller 5*a*, the feeding roller pair 5*b* and the conveying roller pair 5*c*, the sheet material P is fed and conveyed from the sheet tray 4. Then, the sheet material P is conveyed to a transfer position (transferring) between the drum 62 and the transfer roller 7 via the transfer guide 6. At this transfer position, the toner image is successively transferred from the drum 62 onto the sheet material P. The sheet material P on which the toner image is transferred is separated from the drum 62 and then is conveyed to the fixing device 9 along the conveying guide 8. Then, the sheet material P passes through a fixing nip between the heating roller 9*a* and the pressing roller 9*b* which constitute the fixing device 9. At this fixing nip, pressure and heat fixing is effected, so that the toner image is fixed on the sheet material P. The sheet material P on which the toner image is fixed is conveyed to the discharging roller pair 10 and then is discharged onto the discharge tray 11.

As shown in FIG. 3, the drum 62 after the transfer is, after a residual toner on the outer peripheral surface of the drum 62 is removed by a cleaning blade 77, used again in the image forming process. The residual toner removed from the drum 62 is stored in a residual toner chamber 71*b* of a cleaning unit 60.

In this embodiment, the charging roller 66, the developing roller 32, and the cleaning blade 77 are the process means actable on the drum 62.

[Mounting and Demounting of Cartridge]

Figure 4:
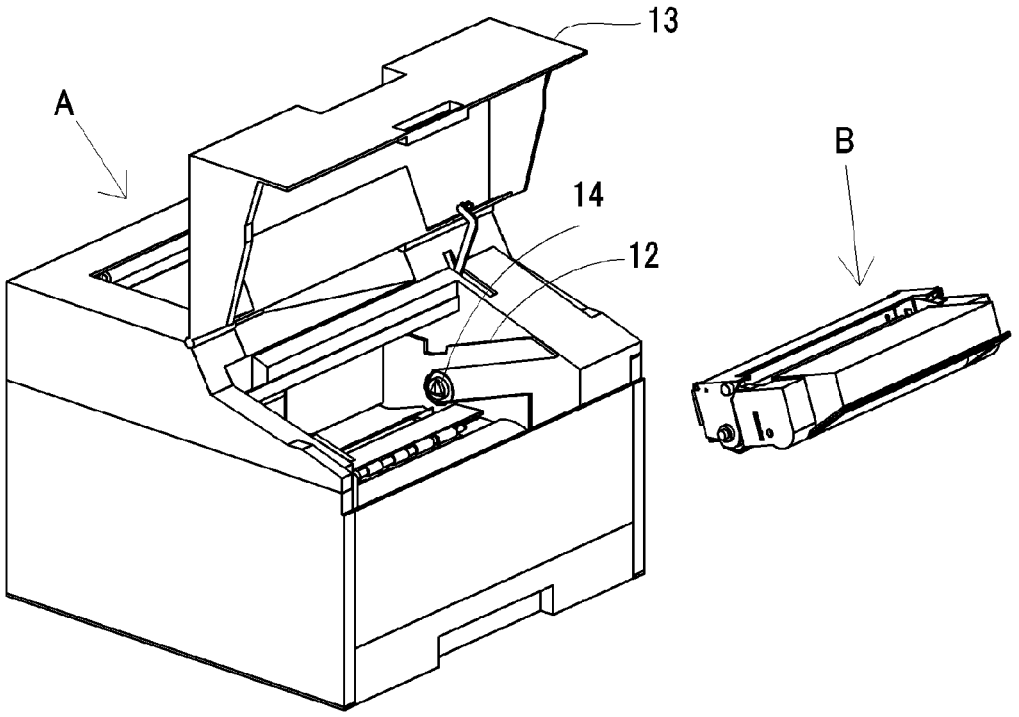
FIG. 4 is a perspective view showing a state of mounting and demounting of a cartridge relative to an image forming apparatus main assembly.

With reference to FIG. 4, mounting and demounting of the cartridge B relative to the apparatus main assembly A will be described. FIG. 4 is a perspective view showing a state of mounting and demounting of the cartridge B relative to the apparatus main assembly A, and shows a state in which an openable door 13 of the apparatus main assembly A is opened for mounting and demounting the cartridge B.

To the apparatus main assembly 1, the openable door 13 is rotatably mounted. When this openable door 13 is opened, a guide rail 12 is provided, and the cartridge B can be mounted in the apparatus main assembly A along the guide rail 12. Then, a driving shaft 14 to be driven by a motor (not shown) of the apparatus main assembly A is engaged with the driving force receiving portion 63*a* (FIG. 6) provided on the cartridge B. As a result, the drum 62 connected with the driving force receiving portion 63*a* receives a rotational force from the apparatus main assembly A to rotate. Further, the charging roller 66 and the developing roller 32 are supplied with electric power from electric power supplying portion (not shown) of the apparatus main assembly A.

[General Structure of Cartridge]

Figure 5:
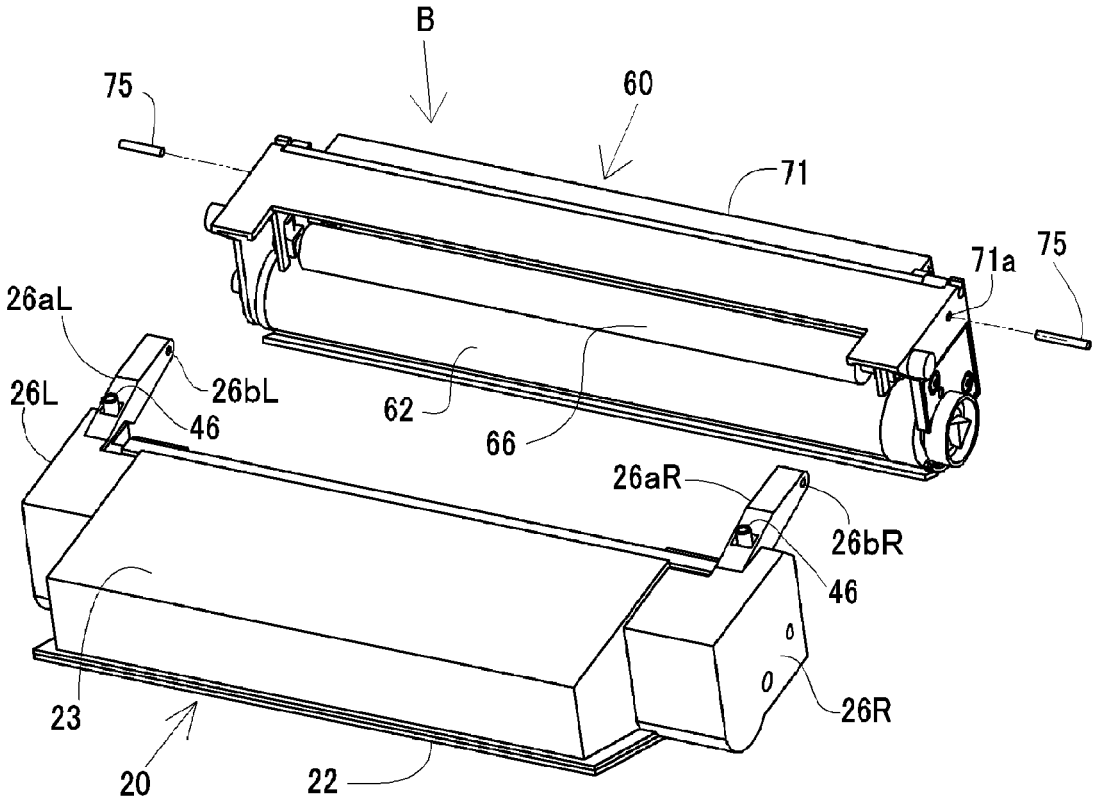
FIG. 5 is a perspective view for illustrating a structure of the process cartridge according to Embodiment 1.

With reference to FIGS. 3 and 5, a general structure of the cartridge B will be described. FIG. 4 is a perspective view for illustrating a structure of the cartridge B in this embodiment.

The cartridge B is constituted by combining the cleaning unit 60 and the developing device unit 20. The cleaning unit 60 is constituted by a cleaning frame 71, the drum 62, the charging roller 66, the cleaning blade 77 and the like. The developing device unit 20 is constituted by a developing container 23, a bottom member 22, first and second side members 26L and 26R, a developing blade 42, the developing roller 32, a magnet roller 34, the feeding member 43, the toner T, an urging member 46, and the like. The cleaning unit 60 and the developing device unit 20 are rotationally movably connected with each other by a connecting member 75, so that the cartridge B is constituted. Incidentally, the developing device unit 20 may also be provided independently from the cartridge B so as to be detachably mountable to the image forming apparatus main assembly or the cartridge B.

Specifically, at end portions of arm portions 26*a*L and 26*a*R formed on the first and second side members 26L and 26R provided at end portions of the developing device unit 20 with respect to a longitudinal direction of the developing device unit 20, rotational movement holes 26*b*L and 26*b*R in parallel with the developing roller 32 are provided. Here, the longitudinal direction of the developing device unit 20 is an axial direction of the developing roller 32. Further, at each of longitudinal end portions of the cleaning frame 71, an engaging hole 71*a* for permitting engagement therein of the connecting member 75 is formed. Then, the arm portions 26*a*L and 26*a*R are aligned with predetermined positions of the cleaning frame 71, and then the connecting members 75 are inserted into the rotational movement holes 26*b*L and 26*b*R and the engaging holes 71*a*. As a result, the cleaning unit 60 and the developing device unit 20 are connected with each other rotatably about the connecting members 75. At this time, urging members 46 mounted at base portions of the arm portions 26*a*L and 26*a*R abut against the cleaning frame 71, so that the urging members 46 urge the developing device unit 20 toward the cleaning unit 60 with the connecting members 75 as the rotation centers. As a result, the developing roller 32 is pressed toward the photosensitive drum 62 with reliability. Then, by a gap (spacing) holding member 38 (FIG. 7) mounted at each of the end portions of the developing roller 32, the developing roller 32 is held with a predetermined gap from the drum 62.

[Structure of Cleaning Unit]

Figure 6:
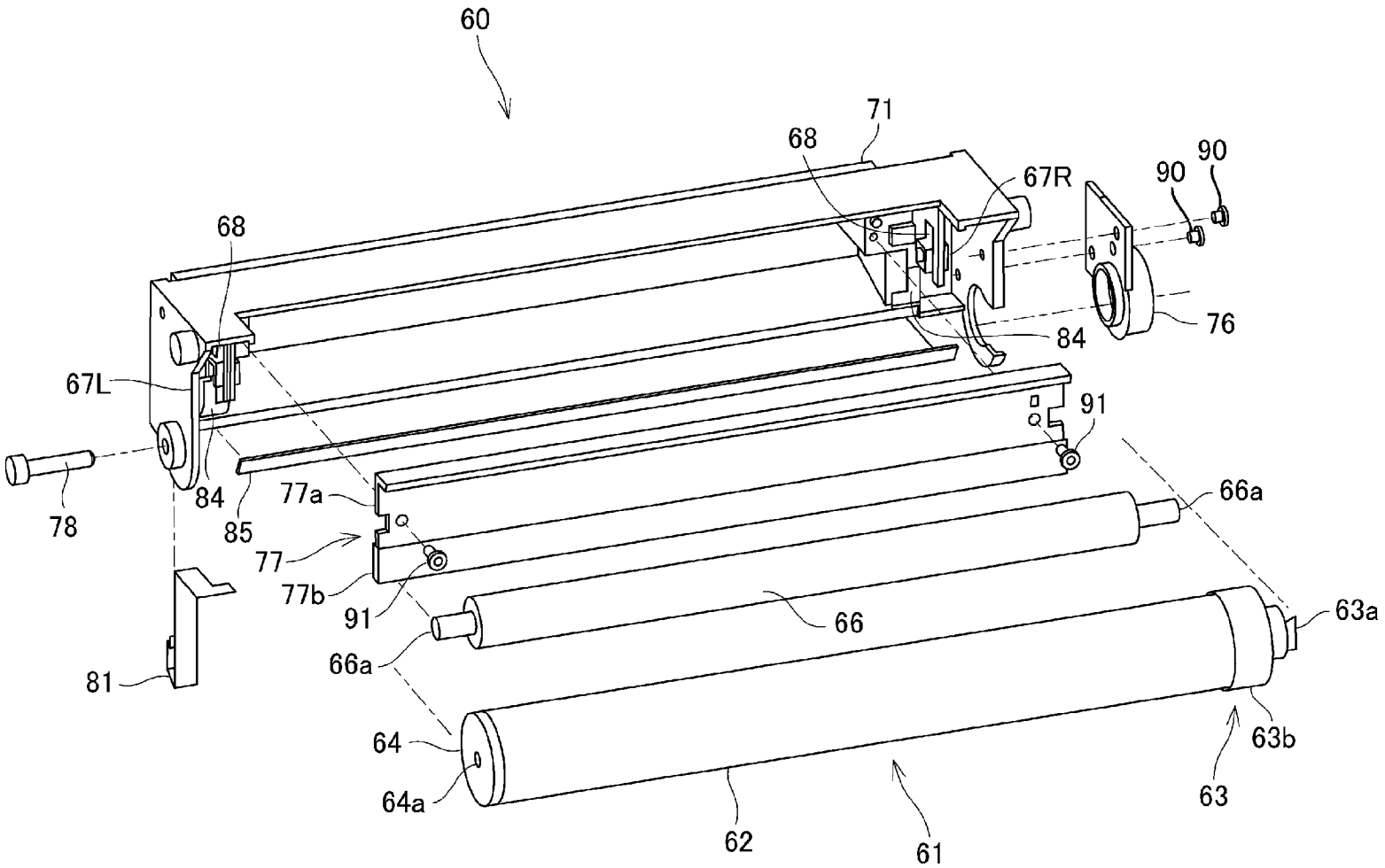
FIG. 6 is a perspective view for illustrating a structure of a cleaning unit according to Embodiment 1.

A structure of the cleaning unit 60 will be described with reference to FIG. 6. FIG. 6 is an exploded perspective view for illustrating the structure of the cleaning unit 60 in this embodiment.

A cleaning blade 77 is constituted by a supporting member 77*a* formed with a metal plate and an elastic member 77*b* formed of an elastic material such as urethane rubber, and is fixed on the cleaning frame 71 by screws 91 at longitudinal end portions of the supporting member 77*a*, thus being provided in a predetermined position. The elastic member 77*b* contacts the drum 62, so that the residual toner is removed from the outer peripheral surface of the drum 62. The removed toner is stored in the residual toner chamber 71*b* (FIG. 3). Incidentally, a receptor sheet 85 is provided in contact with the drum 62 at an opposing position to an end of the cleaning blade 77. An end portion seal 84 is provided for sealing between the cleaning frame 71 and each of end portions of the receptor sheet 85.

An electrode plate 81, an urging member 68 and charging roller bearings 67L and 67R are mounted on the cleaning frame 71.

A shaft portion 66*a* of the charging roller 66 is engaged into the charging roller bearings 67L and 67R. The charging roller 66 is urged toward the photosensitive drum 62 by the urging member 68, and is rotatably supported by the charging roller bearings 67L and 67R. Then, the charging roller 66 is rotated by rotation of the drum 62.

The drum 62 is connected integrally with flanges 63 and 64 and thus is constituted as an electrophotographic photosensitive drum unit 61. This connecting method uses caulking, bonding, welding or the like. To the flange 64, an unshown grounding contact and the like are connected. Further, the flange 63 includes a driving force receiving portion 63*a* for receiving a driving force from the apparatus main assembly A and includes a flange gear portion 63*b* for transmitting the driving force to the developing roller 32. The bearing member 76 is integrally fixed on the cleaning frame 71 with screws 90 in the driving side, and the drum shaft 78 is press-fitted and fixed in the cleaning frame 71 in the non-driving side. Further, the bearing member 76 is engaged with the flange 63, and a drum shaft 78 is engaged with a hole 64*a* of the flange 64. As a result, the drum unit 61 is rotatably supported by the cleaning frame 71.

[Developing Device Unit]

Figure 7:
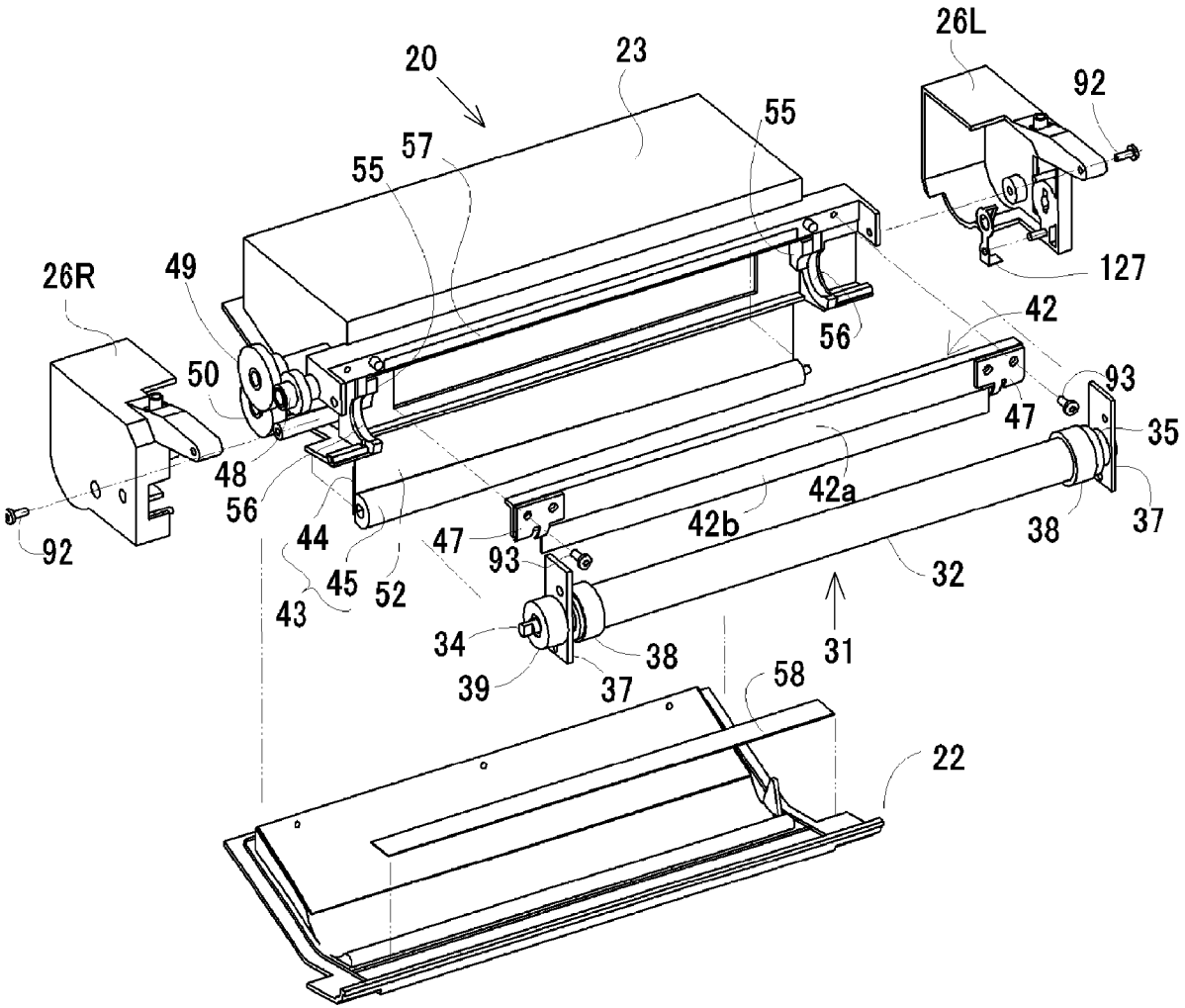
FIG. 7 is a perspective view for illustrating a structure of the developing device unit according to Embodiment 1.

A structure of the developing device unit 20 will be described with reference to FIG. 7. FIG. 7 is an exploded perspective view for illustrating the structure of the developing device unit 20 in this embodiment.

A developing (device) frame (developer container) consisting of the developing container 23 and the bottom member 22 defines the toner chamber 29 in which the toner T is accommodated, and the toner supplying chamber 28 (FIG. 3). The developing container 23 and the bottom member 22 are integrally connected with each other by welding or the like. The feeding member 43 is constituted by a feeding sheet 44 and a rotatable member 45. The feeding member 43 is supported by the developing container 23 in the non-driving side, and is supported by a feeding gear 50 mounted in the developing container 23 in the driving side. As a result, the feeding member 43 is rotated in the toner chamber 29 by the rotation of the feeding gear 50. The feeding member 43 has not only the function of feeding the toner T from the inside toward the outside of the toner chamber 29, i.e., toward the toner supplying chamber 28 but also the function as a stirring member for stirring the toner T in the toner chamber 29.

A first seal member 55, a second seal member 56 and a third seal member 57 and fixed at predetermined develops of the developer container 23 by a double-side tape or the like. A fourth seal member 58 is, after the developer container 23 and the bottom member 22 are connected with each other, fixed at a predetermined position of the bottom member 22 by the double-side tape or the like. The first seal member 55 prevents leakage at the toner T from each of longitudinal end portions of the elastic member 42*b* of the developing blade 42. The second seal member 56 prevents the leakage of the toner T from each of longitudinal end portions of the developing roller 32. The third seal member 57 is provided over the longitudinal direction and prevents the leakage of the toner T from a back side of the supporting member 42*a* of the developing blade 42. The fourth seal member 58 is provided over the longitudinal direction in contact with the developing roller 32 and prevents the leakage of the toner T from a lower side of the developing roller 32.

The developing blade 42 is constituted by a supporting member 42*a* formed with a metal plate and an elastic member 42*b* formed of an elastic material such as an urethane rubber, and is fixed together with a cleaning member 47 in a predetermined position relative to the developing container 23 by 93 at end portions of the supporting member 42*a*. A developing roller unit 31 is constituted by the developing roller 32, the magnet roller 34, a flange 35, the gap holding member 38, a bearing member 37, a developing roller gear 39 and the like. From an end portion of the developing roller 32 in the non-driving side, the magnet roller 34 is inserted, and at the end portion, the flange 35 is press-fitted and fixed.

Here, the rotation shafts of the drum 62, the rotatable member 45 and the developing roller 32 are disposed in parallel to each other. In the flange 35, an electroconductive electrode wire (not shown) is incorporated, and the electrode wire contacts the developing roller 32 and an electrode plate 127. The electroconductive electrode plate 127 is fixed to the first side member 26L. The electrode plate 127 contacts the electric power supplying portion (not shown) of the apparatus main assembly A, so that the electric power is supplied to the developing roller 32 using the electrode wire as an electric power supplying path.

The gap holding member 38 is mounted at each of the end portions of the developing roller 32. Further, outside the gap holding member 38, the bearing member 37 is disposed, and in the driving side, the developing roller gear 39 is assembled outside the bearing member 37. By the bearing member 37 disposed at each of the end portions of the developing roller 32, the developing roller 32 is rotatably supported.

First and second gears 48 and 49 as a drive transmission member are rotatably engaged with the developing frame 1. As a result, the rotation driving force received from the apparatus main assembly A is transmitted to the developing roller 32 and the feeding member 43 by successive engagement and rotation of the flange gear portion 63*b* (FIG. 6), the developing roller gear 39, the first and second gears 48 and 49, and the feeding gear 50. The first and second side members 26L and 26R are fixed with screws 92 at end portions, respectively, of the developing frame with respect to the longitudinal direction of the developing frame. At that time, the bearing members 37 of the developing roller unit 31 are held by the first and second side members 26L and 26R.

[Structure of Toner Seal Member and Removing Operation]

(Toner Seal Member Toner Feeding Portion)

Figure 1:
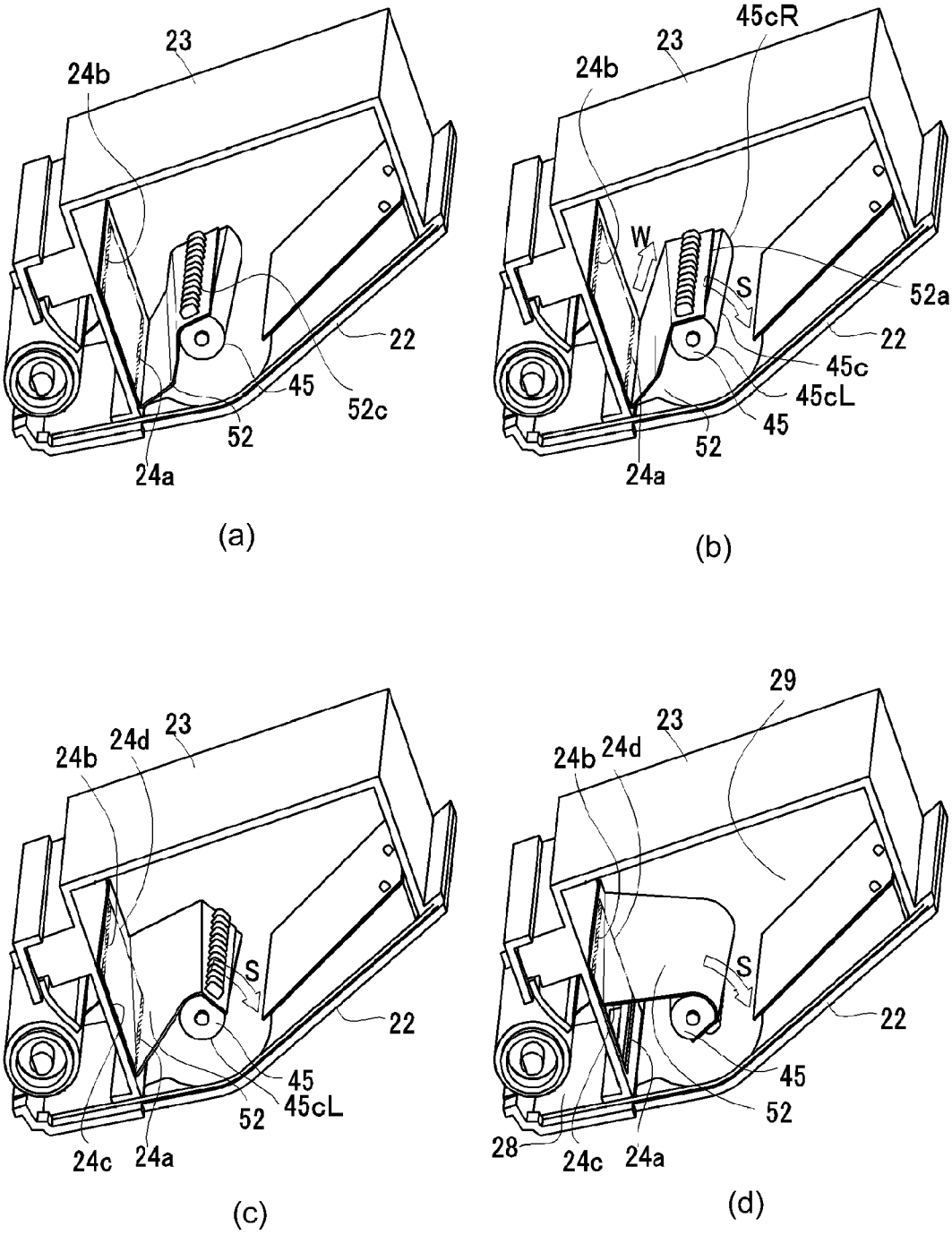
In FIG. 1, (a) to (d) are perspective views of a developing device unit according to Embodiment 1.
Figure 8:
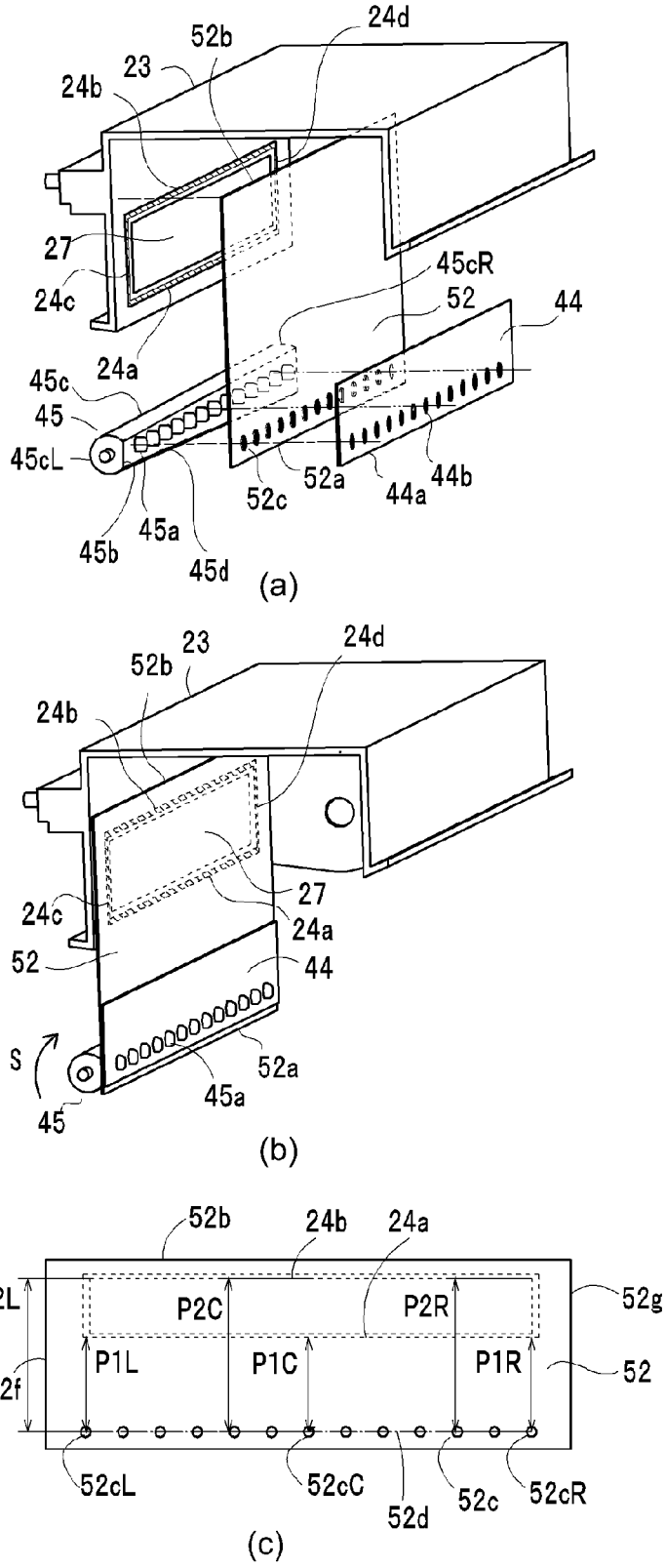
In FIG. 8, (a) to (c) are perspective views for illustrating the structure of the developing device unit according to Embodiment 1.
Figure 9:
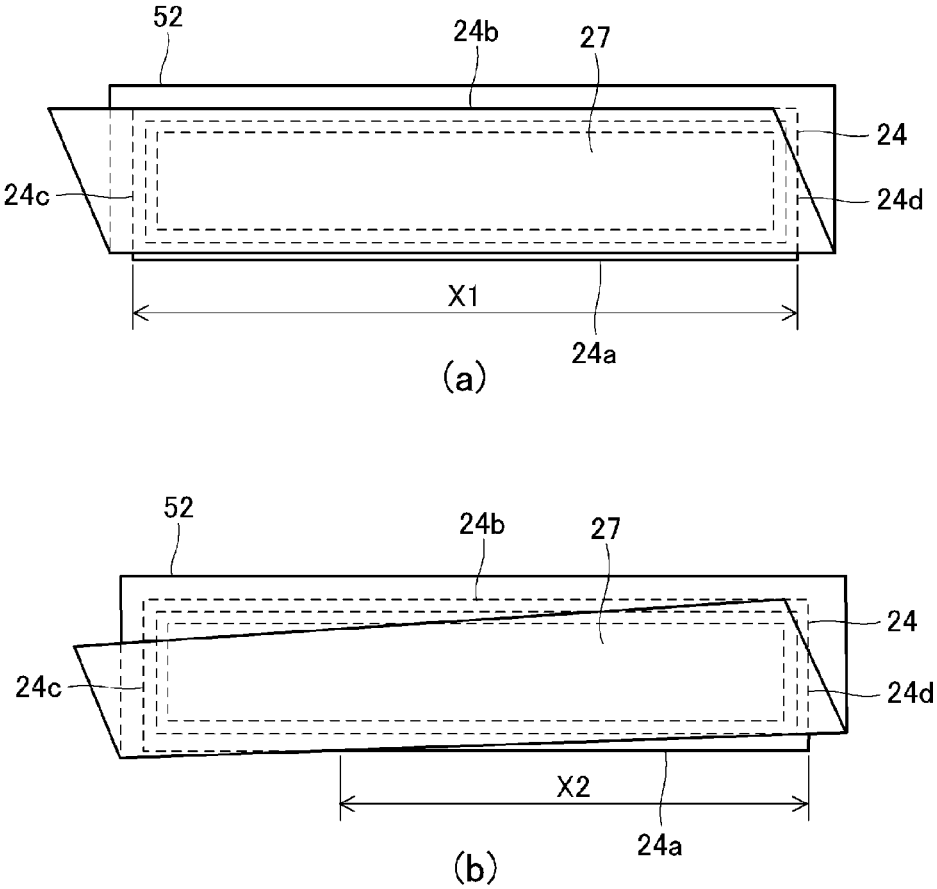
In FIG. 9, (a) and (b) are schematic views for illustrating a peeling-off manner of a toner seal member in Embodiment 1.

With reference to (a) to (d) of FIG. 1 and (a) of FIG. 8 to (b) of FIG. 9, a toner seal structure will be described. In FIG. 1, (a) to (d) are perspective views showing a removing operation of the toner seal member in a time-series manner. In FIG. 8, (a) to (c) are schematic views for illustrating the toner seal structure, in which (a) is an exploded perspective view, and (b) is a perspective view, and (c) is a plan view showing a positional relation between the toner seal member and the sealing portion. In FIG. 9, (a) and (b) are schematic views for illustrating a peeling-off manner of the toner seal member, in which (a) shows the peeling-off manner in Comparison Example, and (b) shows the peeling-off manner in this embodiment.

As shown in (a) of FIG. 8, the developing container 23 is provided with the toner supply opening 27 as an opening for establishing communication between the toner chamber 29 as a developer accommodating chamber and the toner supplying chamber 28 as a developer supplying chamber. The toner seal member 52 as the sealing member is constituted by a material compatible with a material for the developing container 23 or a material including an adhesive layer. The feeding sheet 44 is formed of a flexible material such as polyethylene terephthalate (PET), polycarbonate (PC) or polyphenylene sulfide (PPS).

As shown in (a) of FIG. 8, the rotatable member 45 has an outer configuration in general such that a part of a circular truncated cone shape is vertically cut away. The rotatable member 45 is constituted by an arcuate portion 45*c* and a rectilinear portion 45*b* in cross section (perpendicular to the rotation shaft) as seen in the longitudinal direction. That is, the rotatable member 45 has a shape such that the circular truncated cone shape is partly cut away to form a mounting surface (connecting surface) 45*d* to the toner seal member 52 at a cut-away portion. The arcuate portion 45*c* has a shape such that an outer configuration thereof gradually changes (monotonically decreases) from a driving side arcuate portion 45*c*R toward a non-driving side arcuate portion 45*c*L, and a peripheral length of the arcuate portion 45*c* as seen in the longitudinal direction in cross section is constituted so as to gradually increase from the non-driving side toward the driving side.

Further, the center of the arcuate portion 45*c* in each of cross sections as seen in the longitudinal direction coincides with a rotation center of the rotatable member 45. The mounting surface 45*d* constituted by the rectilinear portion in cross section as seen in the longitudinal direction is a flat plane extending along the longitudinal direction, and a plurality of projections 45*a* are provided in parallel to the rotation shaft of the rotatable member 45. A boundary line between the arcuate portion 45*c* and the mounting surface 45*d* in an upstream side of the rotational direction S is constituted in non-parallel to the rotation shaft so that the boundary line is gradually spaced from the rotation shaft from the non-driving side toward the driving side and extends in a direction toward the upstream side of the rotational direction S.

As shown in (a) of FIG. 8, the toner seal member 52 has the same width as the mounting surface 45*d* with respect to the longitudinal direction (the rotational axis direction of the rotatable member 45). Further, a first end portion 52*a* as an end portion of the toner seal member 52 with respect to a direction (the rotational direction of the rotatable member 45) perpendicular to the longitudinal direction is provided with a plurality of holes 52*c*. Also the feeding sheet 44 is provided with a plurality of holes 44*b* at a first end portion 44*a* thereof as an end portion with respect to the direction perpendicular to the longitudinal direction. The mounting surface 45*d* of the rotatable member 45 is provided with a plurality of projections 45*a*. The projections 45*a* are inserted into the holes 52*c* of the toner seal member 52 and the holes 44*b* of the feeding sheet in the listed order.

Thereafter, by thermally caulking the projections 45*a* of the rotatable member 45, the toner seal member 52, the feeding sheet 44 and the rotatable member 45 are integrally provided. Here, a method of integrating (connecting) the toner seal member 52, the feeding sheet 44 and the rotatable member 45 may also be another method using welding, snap-fitting, double-side tape or the like, and is not necessarily limited.

The toner seal member 52 is required to have a length in which the toner seal member 52 can cover the toner supply opening 27 and is mountable on the rotatable member 45. Here, in order to prevent the end portion of the toner seal member 52, wound up by the rotatable member 45 after the toner supply opening 27 is unsealed, from contacting the end of the feeding sheet 44, the feeding sheet 44 and the toner seal member 52 have the same mounting phase as described above (FIG. 8).

As shown in (b) of FIG. 8 a second end portion 52*b* as the other end portion of the toner seal member 52 with respect to the direction perpendicular to the longitudinal direction is welded on the developing container 23 along an edge of the toner supply opening 27 by the thermal welding or the like. This welded portion is the sealing portion 24 as bonding portion. Here, the sealing portion 24 is configured to have a substantially rectangular shape, surrounding the toner supply opening 27, consisting of two sides extending in the longitudinal directions and other two sides extending in the direction perpendicular to the longitudinal direction. Specifically, the sealing portion 24 is constituted by a first sealing portion 24*a* and a second sealing portion 24*b* which are provided along a longitudinal direction of the toner supply opening 27 and by a third sealing portion 24*c* and a fourth sealing portion 24*d* which are provided along a widthwise direction (the direction perpendicular to the longitudinal direction) of the toner supply opening 27. Incidentally, the first sealing portion 24*a* and the second sealing portion 24*b* are parallel to each other, and are also parallel to the rotation shaft of the rotatable member 45. Further, the rotatable member 45 rotates in the arrow S direction. The first sealing portion 24*a* is located in the first end portion 52*a* side of the toner seal member 52 with respect to the toner supply opening 27, and the second portion 24*b* is located in an opposite side (second end portion 52*a* side). The third sealing portion 24*c* is located in the non-driving side of the toner seal member 52 with respect to the toner supply opening 27, and the fourth sealing portion 24*d* is located in the driving side. The first to fourth sealing portions 24*a* to 24*d* are continuously formed so as to enable sealing of the toner. Of portions, bonded to the first and second sealing portions 24*a* and 24*b*, of the toner seal member 52, the central portion with respect to the longitudinal direction constitutes a central portion sealing portion for sealing a central portion of the toner supply opening 27. Further, of the portions, bonded to the first and second sealing portions 24*a* and 24*b*, of the toner seal member 52, both end portions with respect to the longitudinal direction constitutes end portion sealing portions for sealing end portions of the toner supply opening 27. In order that the end portion sealing portion is peeled earlier from the toner supply opening 27 than the central portion sealing portion, the outer configuration of the rotatable member 45 is constituted so as to be different between an end and a center of the rotatable member 45, with respect to the rotational axis direction, where the toner seal member 52 is contained with the rotatable member 45.

Incidentally, a method of applying the toner seal member 52 onto an edge of the toner supply opening 27 is not limited to the welding but may also be bonding via an adhesive member or a bonding method of application via an adhesive.

The positional relation between the toner seal member 52 and the sealing portion 24 will be further described specifically with reference to (c) of FIG. 8. A line connecting centers of the holes 52*c* is taken as a hole center line 52*d*, and a distance between the hole center line 52*d* and each of the first and second sealing portions 24*a* and 24*b* with respect to a winding-up direction W of the toner seal member 52 will be considered. In the following, a length relation of distances from the hole center line 52*d* will be described by using three points in the driving side, a central portion side and the non-driving side.

Of the holes 52*c*, the hole corresponding to a longitudinal driving side end portion is a driving side hole 52*c*R, the hole corresponding to a longitudinal central portion is a central portion hole 52*c*C, and the hole corresponding to a longitudinal non-driving side end portion is a non-driving side hole 52*c*L. Distances from the first sealing portion 24*a* at positions of the driving side hole 52*c*R, the central portion hole 52*c*C and the non-driving side hole 52*c*L are a first driving side length P1R, a first central portion length PIC and a first non-driving side length P1L, respectively. Similarly, corresponding distances from the second sealing portion 24*b* are a second driving side length P2R, a second central portion length P2C and a second non-driving side length P2L, respectively.

In this embodiment, the hole center line 52*d* is parallel to the first and second sealing portions 24*a* and 24*b*, so that a length relation is P1L=P1C=P1R and P2L=P2C=P2R. When the rotatable member 45 as a winding-up member for winding up the toner seal member 52 is rotated, the toner seal member 52 is wound up in the arrow W direction, so that the toner supply opening 27 is unsealed (exposed).

As shown in (a) of FIG. 1, the toner seal member 52 is constituted so as to be loosened at a portion between the welding portion thereof with the first sealing portion 24*a* and the holes 52*c* as a mounting portion to the rotatable member 45 in a state immediately after assembling (before the unsealing operation of the toner supply opening 27). As a result, even when some force acts on the rotatable member 45 during assembling and transportation of the process cartridge B, the toner seal member 52 is partly loosened and therefore application of tension to the toner seal member 52 is suppressed, so that a sealing force can be maintained.

(Unsealing Operation of Toner Supply Opening)

The unsealing operation of the toner supply opening 27 (a peeling-off operation of the toner seal member 52) performed at the time of start of use of the process cartridge B will be described with reference to (a) to (d) of FIG. 1 and (c) of FIG. 8 to FIG. 11. FIG. 11 is a graph for illustrating a difference in peeling-off timing of the toner seal member depending on a longitudinal position of the toner seal member of the rotatable member. Incidentally, in order to facilitate understanding of the unsealing operation, in FIG. 1, the toner T and the feeding sheet 44 are not shown.

As shown in (a) of FIG. 1, immediately before start of the unsealing operation, as described above, the toner seal member 52 is loosened at the portion between the first sealing portion 24*a* and the holes 52*c*, so that no tension is applied. As shown in (b) of FIG. 1, when the process cartridge B is mounted in the apparatus main assembly A and receives the driving force from the apparatus main assembly A, the rotatable member 45 is rotated in an arrow S direction. Then, the toner seal member 52 is wound up by the rotatable member 45 in the first end portion 52*a* side, and therefore the toner seal member 52 is pulled in the arrow W direction at the portion between the first sealing portion 24*a* and the holes 52*c*.

As described above, a boundary line, of the rotatable member 45, between the arcuate portion 45*c* and the mounting surface 45*d* in an upstream side of the rotational direction S is non-parallel to the rotation shaft so that the boundary line gradually moves away from the rotation shaft from the non-driving side toward the driving side and extends toward the upstream side of the rotational direction S ((a) of FIG. 8). Further, a size (peripheral length of the arcuate portion 45*c*) of the cross section perpendicular to the rotation shaft is constituted so as to gradually increase from the non-driving side toward the driving side. Accordingly, as shown in (b) of FIG. 1, when the rotatable member 45 is rotated, tension is applied to the toner seal member earlier in the driving side than in the non-driving side. When the tension is increased and exceeds the limit of a welding strength of the first sealing portion 24*a*, the toner seal member 52 is started to be peeled from a driving side end portion side of the first sealing portion 24*a*. That is, timing from start of winding-up of the toner seal member 52 until the toner seal member 52 is placed in a tension state between the rotatable member 45 and the first sealing portion 24*a* is different with respect to the longitudinal direction, and is earliest at the driving side arcuate portion 45*c*R. In this embodiment, a constitution in which the timing until the toner seal member 52 is in the tension state is slower with an increasing distance from the driving side is employed. Further, also a winding-up amount of the toner seal member 52 gradually increases from the non-driving side toward the driving side, and becomes maximum at the driving side arcuate portion 45*c*R.

As show in FIG. 11, the timing until the tension state of the toner seal member 52 is slower with the increasing distance from the driving side, so that a timing lag is generated in peeling-off of the toner seal member 52. That is, the peeling-off state of the toner seal member 52 is gradually created from the driving side toward the non-driving side. As shown in FIG. 11, the peeling-off state of the toner seal member 52 is first created at timing t1 in the driving side of the rotatable member 45, and then is successively created at timing t2 at a central portion of the rotatable member 45 and at timing t3 in the non-driving side of the rotatable member 45. A speed of an increase in a peeling-off amount (winding-up amount) from the peeling-off state of the toner seal member 52 is highest in the driving side, and gradually decreases from the driving side toward the non-driving side, and is lowest in the non-driving side.

As shown in (c) of FIG. 1, when the rotatable member 45 is further rotated, the winding-up amount gradually increases from the driving side arcuate portion 45*c*R toward the non-driving side arcuate portion 45*c*L and then exceeds the limit of the welding strength of the first sealing portion 24*a*. As a result, the first sealing portion 24*a* of the toner seal member 52 is pulled and peeled off from the driving side toward the non-driving side. Further, the fourth sealing portion 24*d* is pulled and peeled off toward the second sealing portion 24*b*.

As shown in (d) of FIG. 1, when the toner seal member 52 is pulled and peeled off to the driving side of the first sealing portion 24*a*, the third sealing portion 24*c* is pulled and peeled off from the first sealing portion 24*a* toward the second sealing portion 24*b*. When the rotatable member 45 is further rotated, the toner seal member 52 is, similarly as in the case of the first sealing portion 24*a*, pulled and peeled off at the second sealing portion 24*b* from the driving side toward the non-driving side, so that a whole region of the sealing portion 24 is pulled and peeled off. That is, the toner seal member 52 is obliquely peeled off from a boundary portion between the first and fourth sealing portions 24*a* and 24*d* toward a boundary portion between the second and third sealing portions 24*b* and 24*c*.

In this way, the toner seal member 52 is wound up by the rotatable member 45 so that the toner seal member 52 is gradually peeled off from a corner of the substantially rectangular sealing portion toward a diagonal corner of the corner in an oblique direction with respect to the longitudinal direction. As a result, the toner supply opening 27 is unsealed, so that a state in which the toner can be supplied from the toner chamber 29 to the toner supplying chamber 28 by the feeding member 43 is created (FIG. 3).

The above-described length relation is the same with respect to the whole longitudinal region, but on the other hand, the outer configuration of the arcuate portion 45*c* of the rotatable member 45 is the circular truncated cone shape such that the size (peripheral length) gradually changes (monotonically decreases) from the driving side arcuate portion 45*c*R toward the non-driving side arcuate portion 45*c*L. For that reason, on the first and second sealing portions 24*a* and 24*b*, the toner seal member 52 is pulled and peeled off in one direction from the driving side toward the non-driving side via the central portion.

If the outer configuration of the arcuate portion 45*c* of the rotatable member 45 is the same over the whole longitudinal region, the winding-up amount of the toner seal member 52 is the same, and therefore as shown in (a) of FIG. 9, a peeling-off force for peeling off the first sealing portion 24*a* of the toner seal member 52 in a full longitudinal width (width X1) is required. Particularly, the first sealing portion 24*a* is formed over the entire longitudinal region, so that at the rectangular sealing portion, a maximum peeling-off width with respect to the longitudinal direction is X1. Thus, a peeling-off manner is such that a maximum force for peeling off the toner seal member 52 is required at the first sealing portion 24*a*.

On the other hand, in this embodiment, the outer configuration of the rotatable member 45 gradually changes along the longitudinal direction, and therefore as shown in (b) of FIG. 9, the toner seal member 52 can be pulled and peeled off at the first sealing portion 24*a* from the driving side toward the non-driving side with respect to the rotational axis direction of the rotatable member 45 (not shown). A peeling-off width X2 is smaller than the width X1, so that a peeling-off region is narrowed, and therefore the peeling-off force is reduced. For a similar reason, also the peeling-off force for peeling off the toner seal member 52 at the second sealing portion 46*b* can be decreased.

That is, in this embodiment, the peeling-off manner is such that a peeling-off area of the toner seal member 52 is gradually increased from the driving side toward the non-driving side of the rotatable member 45, so that a maximum peeling-off width X2 does not range over the entire longitudinal region, different from the case of Comparison Example ((a) of FIG. 8). At the time when the maximum peeling-off width X2 is created, in the driving side (the right side in (b) of FIG. 8), the peeling-off of the toner seal member 52 at the first sealing portion 24*a* is ended, and thereafter, an area in which the peeling-off of the toner seal member 52 is ended is to be gradually increased toward the non-driving side (the left side of (b) of FIG. 8). In the driving side, after the peeling-off at the first sealing portion 24*a* is ended, a state in which the fourth sealing portion 24*d* is peeled off is created, but a longitudinal peeling-off width of the fourth sealing portion 24*d* in the driving side is not changed from beginning to end, and therefore this state is maintained until the peeling-off at the first sealing portion 24*a* is ended in the non-driving side. Also the second sealing portion 24*b* is formed over the substantially entire longitudinal region, but similarly as in the case of the first sealing portion 24*a*, the peeling-off area is gradually increased from the driving side toward the non-driving side, and therefore the peeling-off width does not range over the entire longitudinal region different from the case of Comparison Example. That is, in this embodiment, a boundary line between an area (bonding area) before the peeling-off of the toner seal member 52 and an area after the peeling-off of the toner seal member 52 in a range between the toner seal member 52 and the sealing portion extends in a direction oblique to the longitudinal direction. Accordingly, in this embodiment, the toner seal member 52 can be peeled off from the sealing portion by a force smaller than a force in Comparison Example.

Incidentally, in this embodiment, as the constitution in the winding-up side of the toner seal member 52, description was made on the premise that the constitution in which the projections 45*a* are engaged with the holes 52*c* is employed (FIG. 8). For that reason, the distance to each of the first and second sealing members 24*a* and 24*b* is defined by using the hole center line 52*d*, but in the case where the toner seal member 52 is fixed by a double-side tape, an adhesive or the like without using the holes 52*c*, a distance from a fixed surface to each of the first and second sealing members 24*a* and 24*b* may only be required to be considered.

As described above, according to this embodiment, a maximum load in an automatic winding-up operation of the toner seal member, in which the load is larger than the load during a normal operation such as the stirring operation can be reduced. Accordingly, it is possible to decrease the influence of the toner seal member winding-up load on a device specification. As a result, it becomes possible to reduce sizes of a motor and a driving system and to employ an inexpensive material, with the result that it is possible to realize downsizing and cost reduction of the electrophotographic image forming apparatus.

[Other Embodiments]

Figure 10:
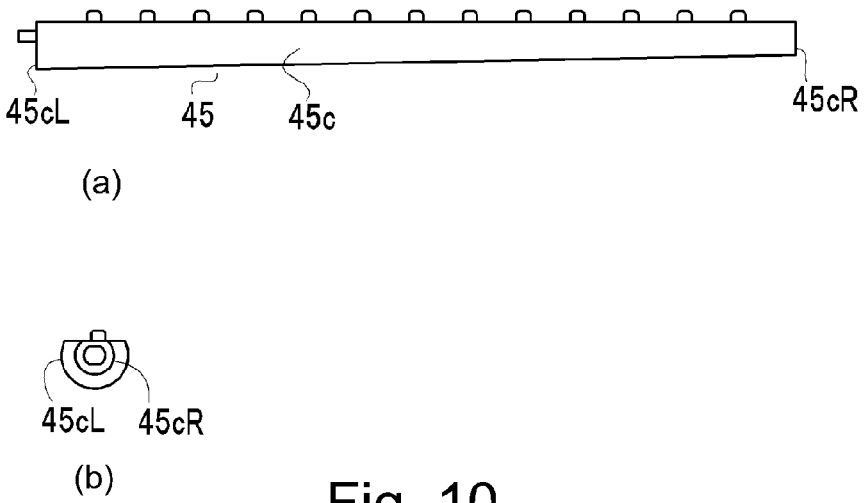
In FIG. 10, (a) and (b) are schematic views showing a structure of a rotatable member in modified Embodiment 1.
Figure 11:
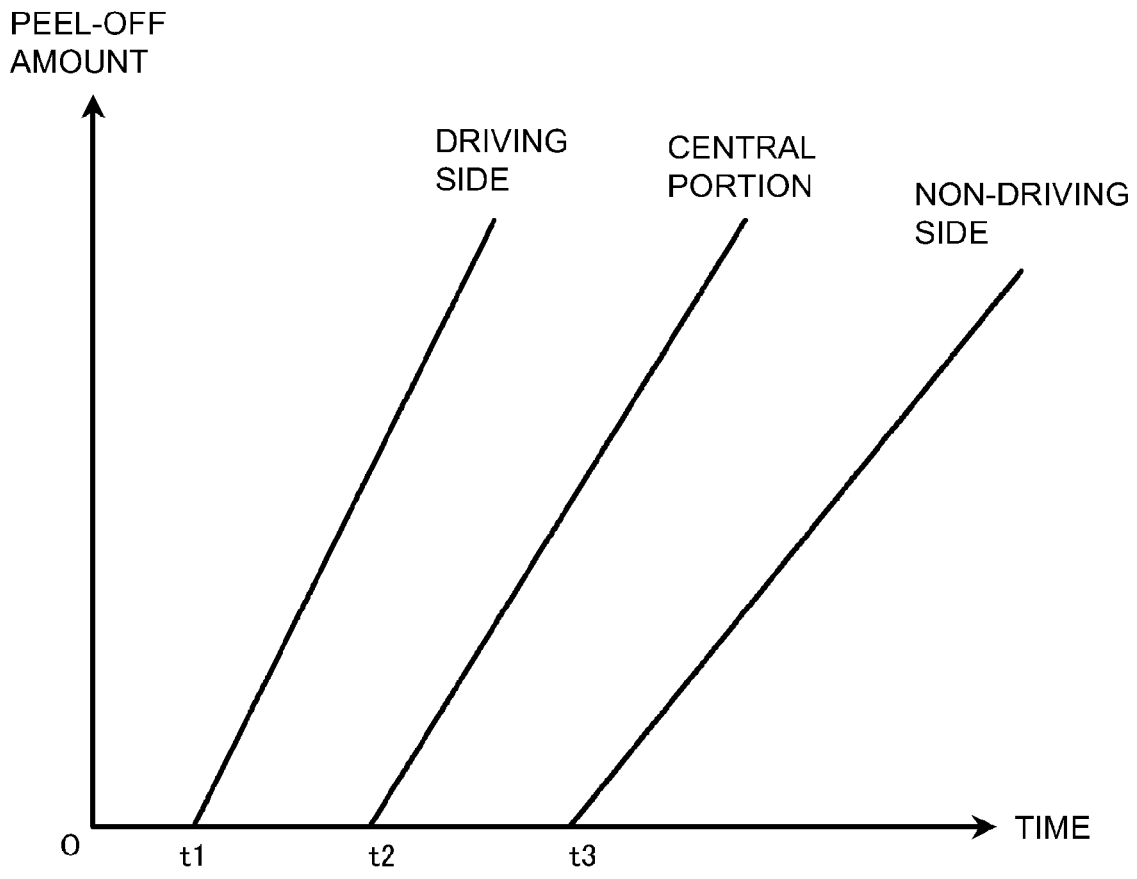
FIG. 11 is a graph for illustrating a difference in peeling-off timing of the toner seal member by the rotatable member.

In FIG. 10, (a) and (b) are schematic views showing another example (modified Embodiment 1) of the structure of the rotatable member, in which (a) is a front view for illustrating a shape of the rotatable member, and (b) is a right side view for illustrating the shape of the rotatable member. In Embodiment 1, the example in which the outer configuration of the rotatable member monotonically decreases from the driving side toward the non-driving side was described, but as shown in (a) and (b) of FIG. 10, the outer configuration relation may also be reversed, i.e., a constitution in which the outer configuration gradually decreases from the non-driving side arcuate portion 45*c*L toward the driving side arcuate portion 45*c*R may also be employed. In this case, the unsealing can be made in one direction from the non-driving side to the driving side, so that a similar peeling-off force reducing effect is obtained.

Figure 12:
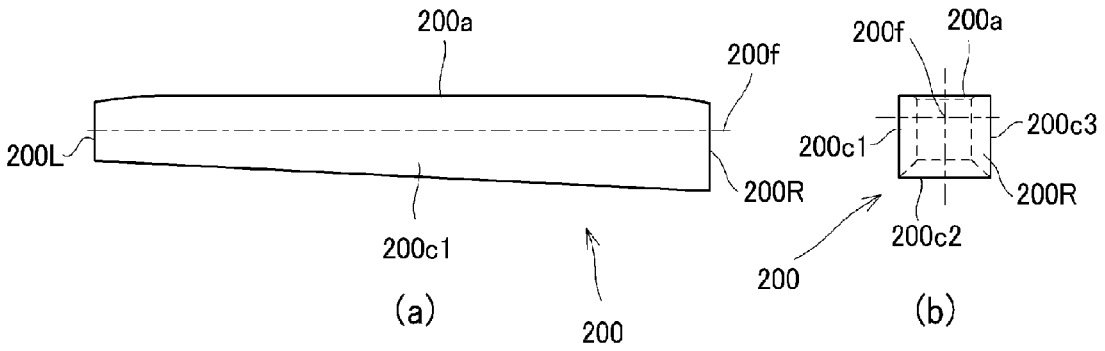
In FIG. 12, (a) and (b) are schematic views showing a structure of a rotatable member in modified Embodiment 2.

In FIG. 12, (a) and (b) are schematic views showing another example (modified Embodiment 2) of the structure of the rotatable member, in which (a) is a front view for illustrating a shape of the rotatable member, and (b) is a right side view for illustrating the shape of the rotatable member. As shown in FIG. 12, a rotatable member 200 has in general an outer configuration of a square truncated pyramid shape, and has a single surface (side) 200*a*, as the toner seal member mounting surface, parallel to a rotation shaft (center axis 200*f*). Other three surfaces (sides) 200*c*1 and 200*c*3 extending in the longitudinal direction are inclined from the rotation shaft so that a cross-sectional area gradually increases from a non-driving side end portion 200L toward a driving side end portion 200R. Even in such a constitution that the outer configuration gradually changes along the longitudinal direction as described above, similarly as in Embodiment 1, the effect of lowering the maximum load required for peeling off the toner seal member is obtained. Other constitutions are the same as those in Embodiment 1.

Figure 13:
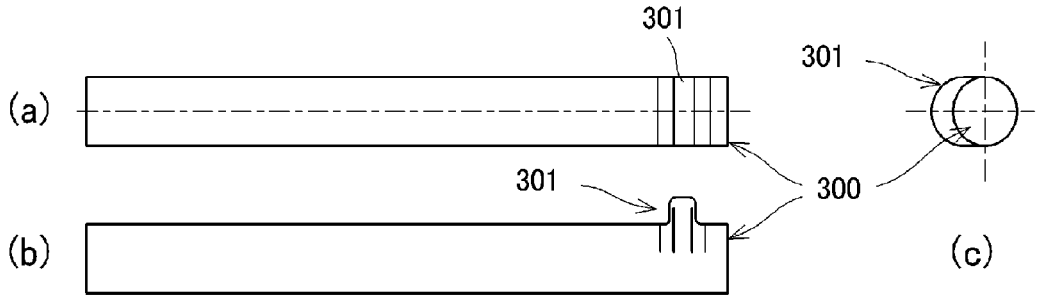
In FIG. 13, (a) to (c) are schematic views showing a structure of a rotatable member in modified Embodiment 3.
Figure 14:
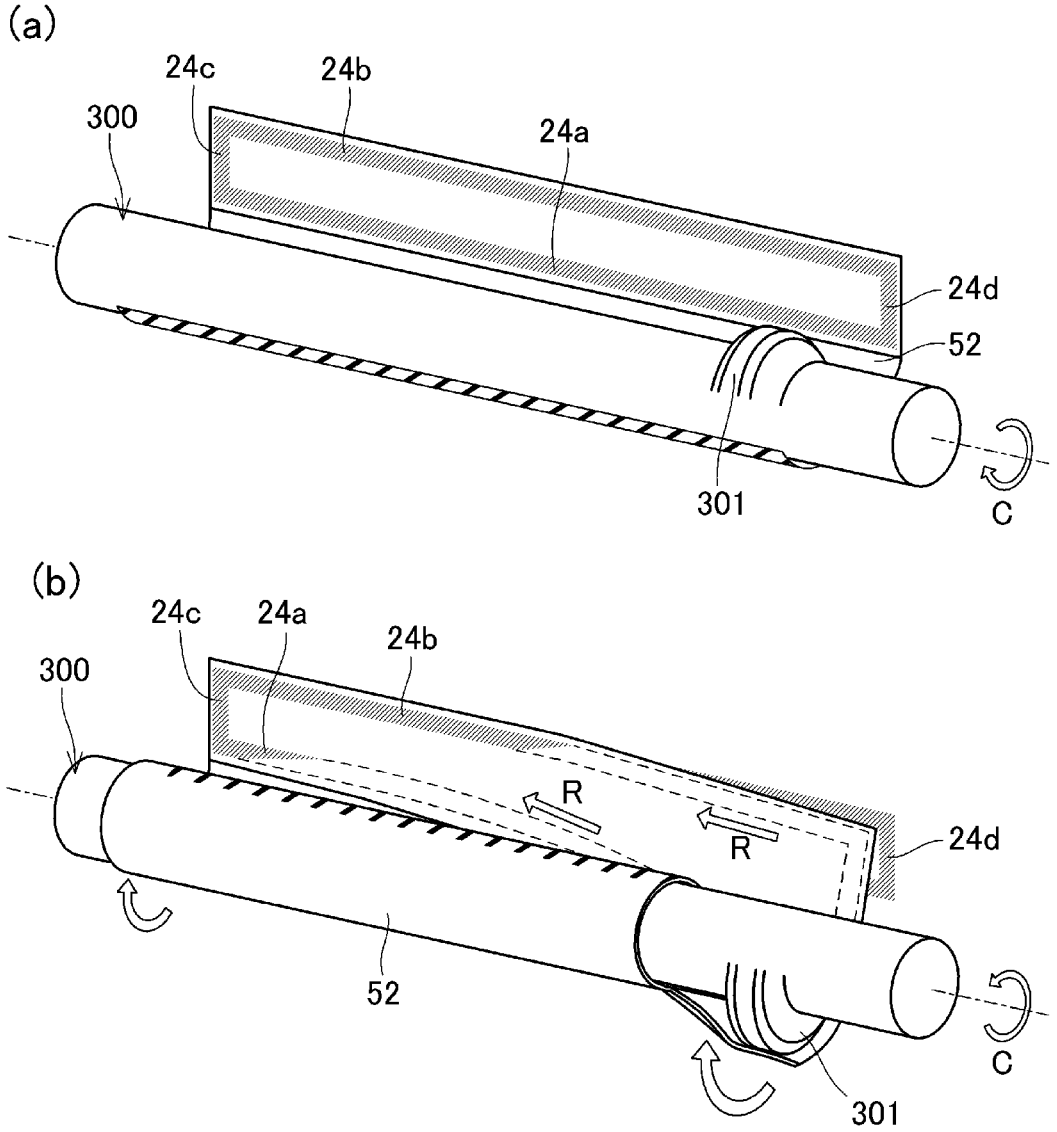
In FIG. 14, (a) and (b) are schematic views showing a peeling-off state of a toner seal member in modified Embodiment 3.

In FIG. 13, (a) and (b) are schematic views showing another example (modified Embodiment 3) of the structure of the rotatable member, in which (a) is a front view for illustrating a shape of the rotatable member, and (b) is a bottom view for illustrating the shape of the rotatable member, and (c) is a right side view for illustrating the shape of the rotatable member. In FIG. 14, (a) and (b) are schematic perspective views showing a state of a toner seal member winding-up (peeling-off) operation by the rotatable member in modified Embodiment 3, in which (a) shows the state before start of the operation, and (b) shows the state after the start of the operation. Incidentally, in (b) of FIG. 14, in order to show the state of the rotatable member at a projected portion, a part of the toner seal member is cut away.

In Embodiment 1, the constitution in which the outer configuration of the rotatable member gradually changes was employed, but the outer configuration of the rotatable member is not limited thereto. The constitution may also be required to be such a constitution that timing until the toner seal member is placed in a tension state between the rotatable member and the sealing portion is slower with an increasing distance from the driving side and that a speed of an increase in toner seal member winding-up amount (peeling-off amount) is slower with the increasing distance from the driving side.

As shown in FIG. 13, a rotatable member 300 has in general an outer configuration such that a cylindrical shape is provided with a projected portion 301 as a part thereof. The projected portion 301 is provided so as to project in a direction perpendicular to the rotational axis of a cylindrical body at a driving side end portion. A shape, a dimension and a position of the projected portion 301 can be appropriately determined within a range in which the effect of the present invention can be achieved.

As shown in (a) of FIG. 14, the toner seal member 52 is welded in a region, of a peripheral surface of the rotatable member 300, opposite from the side where the projected portion 301 is provided. In (a) of FIG. 14, the rotatable member 300 is in a pre-stage of start of rotation thereof, and therefore no tension is not yet generated on the toner seal member 52, so that the toner seal member 52 is in a loosened state. As shown in (b) of FIG. 14, by the rotation of the rotatable member 300, the toner seal member 52 is wound up to be removed, but a toner seal member winding-up speed is different among a longitudinal non-driving side end portion, a longitudinal central portion and a longitudinal driving side end portion. At the longitudinal driving side end portion, the toner seal member 52 is required to be wound up about the rotatable member 300 including the projected portion 301 provided at the longitudinal driving side end portion, and therefore the winding-up speed at the longitudinal driving side end portion is faster than those at other portions. By that speed difference, at the driving side end portion, a time required to eliminate the loosening shown in (a) of FIG. 14 is short, and therefore the unsealing starts at early timing. Further, an unsealing speed at the driving side end portion is high, and therefore the unsealing advances from the driving side end portion toward the central portion, and then advances from the central portion toward the non-driving side end portion. As a result, similarly as in Embodiment 1, the effect of lowering the maximum load required to peeling off the toner seal member is obtained. Other constitutions are the same as those in Embodiment 1.

(Embodiment 2)

An image forming apparatus according to this embodiment will be described. Incidentally, in this embodiment, a portion different from Embodiment 1 will be principally described in detail. Materials, shapes and the like are the same as those in Embodiment 1 unless otherwise specified again. Such the same portions are represented by the same reference numerals or symbols and will be omitted from detailed description.

In Embodiment 1, the rotatable member 45 has a solid shape capable of ensuring rigidity. However, in the case where injection molding using a resinous material is carried out, it would be considered that a hollow shape or a lightening shape (a constitution provided with a plurality of recessed portions as a part of a peripheral surface) formed with ribs having the substantially same thickness is employed in view of ensuring of dimension accuracy and productivity such as shortening of a molding time. In such a case, the rigidity of the rotatable member 45 is lowered, and therefore by tension during winding-up of the toner seal member 52, the rotatable member 45 causes torsion with respect to the rotational direction thereof or flexure with respect to a tension direction. Accordingly, in order to peel off the toner seal member 52 in one direction from the driving side toward the non-driving side with respect to the rotational axis direction as described in Embodiment 1, there is a need to consider the torsion and the flexure of the rotatable member 45.

Figure 15:
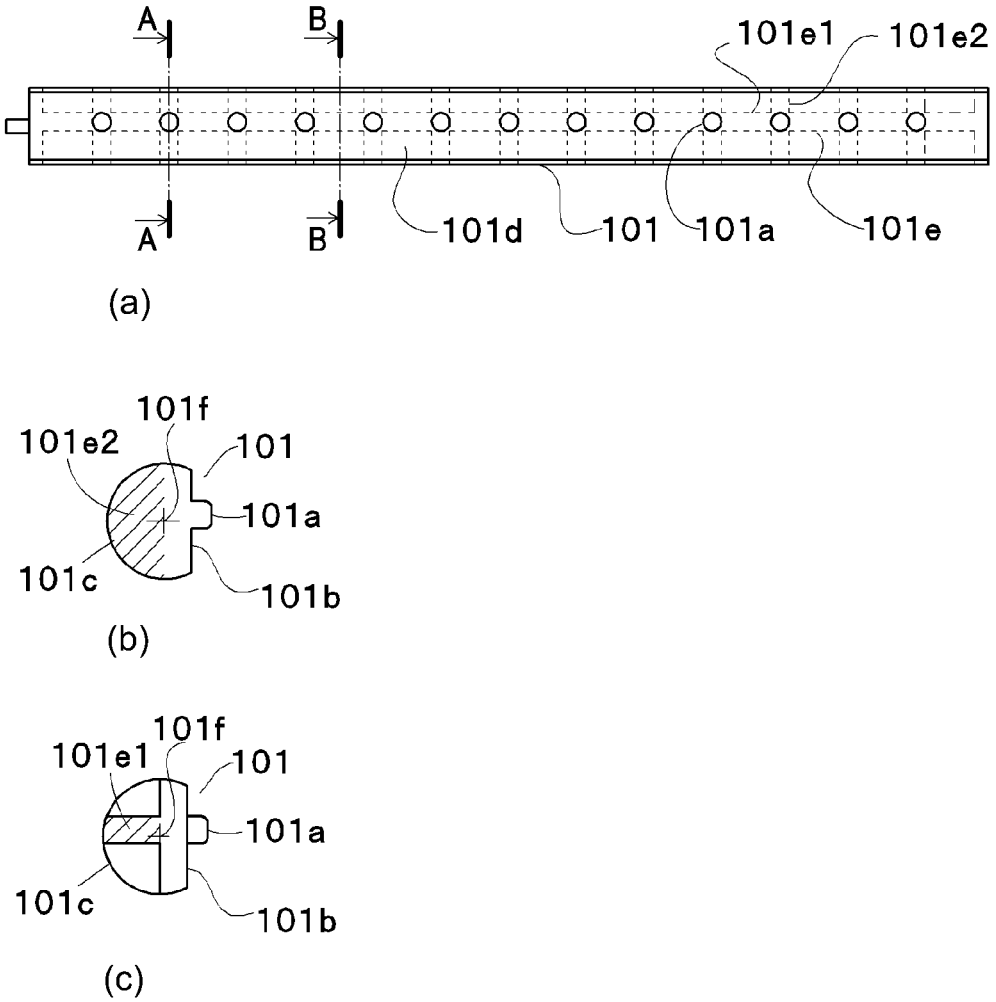
In FIG. 15, (a) to (c) are schematic views showing a structure of a rotatable member in Comparison Example.

With reference to FIG. 15, a rotatable member 101 employing the lightening shape constituted by the ribs will be described.

In FIG. 15, (a) to (c) are schematic views for illustrating the rotatable member 101, in which (a) is a plan view of the rotatable member 101, (b) is an A-A cross-sectional view of (a), and (c) is a B-B cross-sectional view of (a).

When a cross section of the rotatable member 101 is viewed in the longitudinal direction, the cross section ((b) of FIG. 15) constituted by an arcuate portion 101*c* and a rectilinear portion 101*b* and the cross section ((c) of FIG. 15) in which a rib 101*e* is formed by partly depressing the arcuate portion 101*c* appear alternately at predetermined intervals along the longitudinal direction. In each of these cross sections of the two types, a constitution in which a size does not change with respect to the longitudinal direction is employed. Further, a center 101*f* of the arcuate portion 101*c* coincides with a rotation center of the rotatable member 101. A mounting surface 101*d* constituted by the rectilinear portion 101*b* in the cross section as seen in the longitudinal direction is a flat plane, extending along the longitudinal direction, on which a plurality of projections 101*a* are provided in parallel to the rotational axis of the rotatable member 101. A back surface of the mounting surface 101*d* is, as shown by a broken line of (a) of FIG. 15 and by hatched portions of (b) and (c) of FIG. 15, when being viewed from a direction perpendicular to the mounting surface 101*d*, such a constitution that the ribs are provided in a lattice pattern is employed. The ribs provided in the lattice pattern are constituted by longitudinal ribs 101*e*1 extending in the longitudinal direction and a widthwise ribs 101*e*2 extending in a widthwise direction. The widthwise ribs 101*e*2 are provided at positions correspondingly to the projections 101*a* with respect to the longitudinal directions. As a result, even when the tension is applied to the rotatable member 101 during the removal of the toner seal member (not shown), the toner seal member is wound about the arcuate portion 101*c* of the rotatable member 101 with reliability.

In the case where the lightening shape using the ribs as described above is used, an unsealing operation of the toner supply opening 27 (a peeling-off operation of the toner seal member) will be described.

Comparison Example

Figure 16:
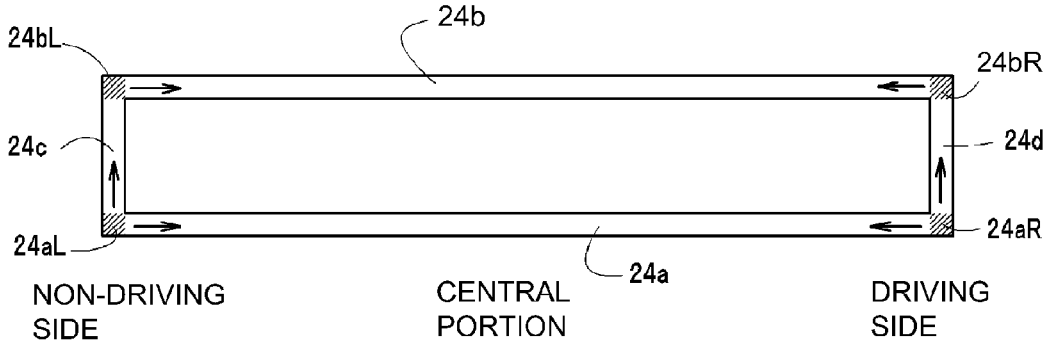
In FIG. 16, (a) to (c) are schematic views for illustrating the rotatable member in Comparison Example.
Figure 16:
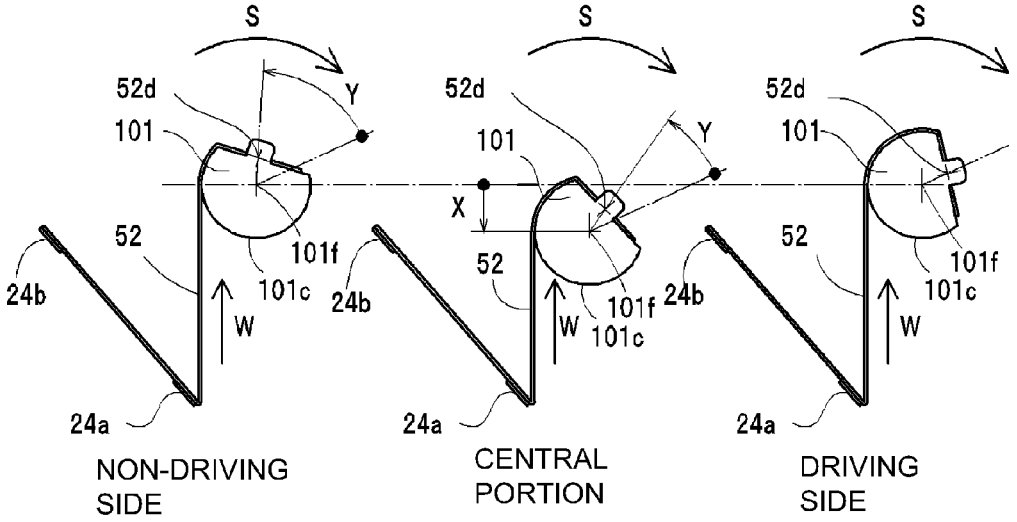
Figure 16:
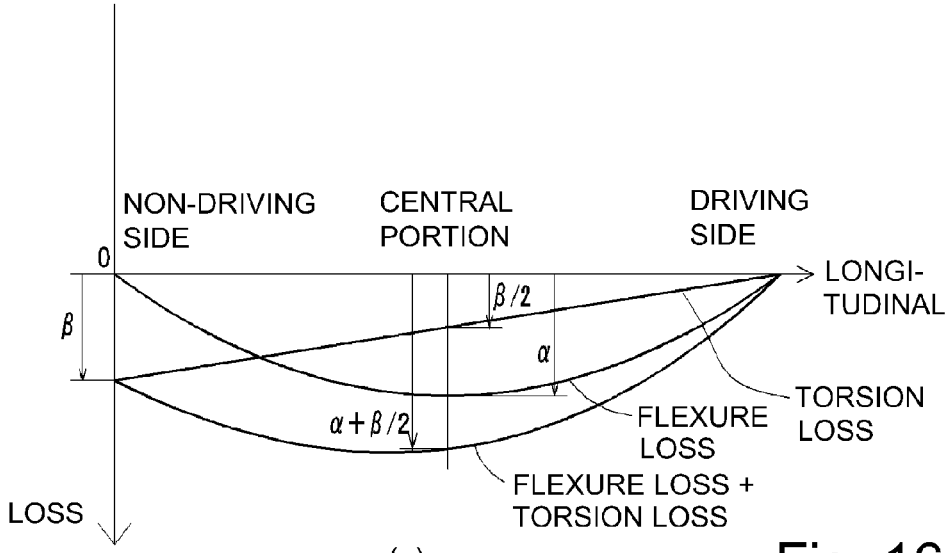

With reference to FIGS. 8 and 16, behavior of the rotatable member 101 when the toner supply opening 27 is unsealed by using the above-described rotatable member 101 will be described. In FIG. 16, (a) to (c) are schematic views for illustrating an unsealing state of the toner supply opening 27 with deformation of the rotatable member 101. In FIG. 16, (a) is the schematic view showing a peeling-off manner of the toner seal member at the sealing portion 24, in which arrows in the figure represent directions in which the unsealing advances. In FIG. 16, (b) includes sectional views showing states of the sealing member 52, the rotatable member 101 and the first and second sealing portions 24*a* and 24*b* at the moment when the sealing member 52 is peeled at the driving side end portion 24*a*R of the first sealing portion 24*a* at three positions of the non-driving side, the central portion, and the driving side, respectively. Incidentally, the feeding sheet 44 is not shown. Further, the driving side, the central portion and the non-driving side represent the cross sections at positions of the driving side hole 52*c*R, the central portion hole 52*c*C and the non-driving side hole 52*c*L, respectively (FIG. 8). In FIG. 16, (c) is a graph showing influence of flexure and torsion generated on the rotatable member 101 in terms of a loss length.

When the rotatable member 101 is rotated in an arrow S direction, tension is applied to a whole f the toner seal member 52, so that the sealing member 52 is peeled first at the driving side end portion 24*a*R of the first sealing portion 24*a* and then is gradually peeled toward the central portion of the first sealing portion 24*a* and toward the fourth sealing portion 24*d*. When the rotatable member 101 is further rotated, the sealing member 52 is peeled at the non-driving side end portion 24*a*L of the first sealing portion 24*a* and then is gradually peeled toward the central portion of the first sealing portion 24*a* and toward the third sealing portion 24*c*. The sealing member 52 is peeled from two directions of the driving side end portion 24*a*R and the non-driving side end portion 24*a*L, so that the peeled portions merge with each other at a position somewhat close to the central portion in the non-driving side.

The peeled portion reaching the fourth sealing portion 24*d* moves toward the central portion of the second sealing portion 24*b* via the driving side end portion 24*b*R of the second sealing portion 24*b*. On the other hand, the other peeled portion reaching the third sealing portion 24*c* at timing somewhat later than timing when the peeled portion reaches the fourth sealing portion 24*d* moves toward the central portion of the second sealing portion 24*b* via the non-driving side end portion 24*b*L of the second sealing portion 24*b*. The sealing member 52 is peeled at the second sealing portion 24*b* from the two directions of the driving side end portion 24*b*R and the non-driving side end portion 24*b*L, so that the peeled portions merge with each other at the position somewhat close to the central portion in the non-driving side.

The reason why the toner seal member 52 is peeled from the two directions as described above will be described. The rotatable member 101 is rotated in the arrow S direction when being rotationally driven, so that the toner seal member 52 is wound up in the arrow W direction. Simultaneously with the winding-up, tension is applied to the toner seal member 52, and reaction force is applied to the rotatable member 101. The rotatable member 101 causes flexure by the reaction force in a direction opposite to the arrow W direction. The rotatable member 101 is supported at both ends thereof, and therefore a degree of the flexure is increased from the end portions toward the central portion and becomes maximum in the neighborhood of the central portion. In FIG. 16, X represents the flexure, and a movement amount with respect to a reference position of the center 101*f* in the driving side (non-driving side) is defined as the flexure X.

Further, the rotatable member 101 causes torsion by the reaction force in a direction opposite to the rotational direction. The rotatable member 101 is driven by the feeding gear 50 (FIG. 7) in the driving side, and is rotatably supported in the non-driving side, and therefore the torsion increases from the driving side toward the non-driving side and becomes maximum in the non-driving side. In FIG. 16, Y represents the torsion, and a deformation amount at a position, other than positions in the driving side, with respect to a reference line connecting the driving side center 101*f* and the hole center line 52*d* is defined as the torsion Y.

These flexure and torsion acts on the toner seal member 52 in directions opposite to the winding-up direction for the toner seal member 52, and therefore cause winding-up loss. Due to the loss, a difference in degree of application of the tension with respect to the longitudinal direction is generated, so that the unseal is started from a position where the loss is less. The influences of the flexure and the torsion are converted into winding-up loss lengths and are shown in the graph of (c) of FIG. 16.

When a value obtained by converting the flexure into loss length on the basis of the driving side is defined as flexure loss, the flexure loss is the movement amount itself of the center 101*f* at each of longitudinal positions on the basis of the driving side. The flexure loss shows a curve such that the flexure loss is 0 at supporting positions (driving side end portion and non-driving side end portion) and reaches maximum in the neighborhood of the central portion as if the flexure loss is that of both-end-supported beam. Here, maximum flexure loss generated at the central portion is represented by a.

Further, when a value obtained by converting the torsion into loss length on the basis of driving side is defined as torsion loss, the torsion loss is a value obtained by multiplying a torsion amount at each of longitudinal positions on the basis of the driving side by a radius of the arcuate portion 101*c*. The arcuate portion 101*c* of the rotatable member 101 has a size uniform with respect to the longitudinal direction, and therefore the torsion loss is proportional to the torsion amount. This torsion loss shows a rectilinear line such that the torsion loss is 0 at the driving side end portion and reaches maximum at the non-driving side end portion as if the torsion loss is that of a cantilever. Here, maximum torsion loss generated in the non-driving side is represented by β. At the central portion, the torsion loss is 2/β.

In FIG. 16, the sum of the flexure loss and the torsion loss is represented by "FLEXURE LOSS+TORSION LOSS". The "FLEXURE LOSS+TORSION LOSS" shows a curve such that a value thereof in increased in the order of the driving side, the non-driving side and the central portion, so that based on this result, it is possible to explain that the unsealing is made in the same order. Further, as a condition in which the value is largest at the central portion, the following relationship holds.

$$(\text{maximum flexure loss } \alpha) > (\text{maximum torsion loss } \beta)/2$$

Incidentally, in this embodiment, the reason why the toner seal member 52 is peeled from the two directions by the influences of the torsion and the flexure is described by taking the unsealing at the first sealing portion 24*a* as an example, but this is true for the second sealing portion 24*b*.

As described above, by the flexure and the torsion, when the toner seal member 52 is peeled from the longitudinal two directions at each of the first and second sealing portions 24*a* and 24*b*, there is a need to ensure a peeling-off force correspondingly to two longitudinal positions at each of the first and second sealing portions 24*a* and 24*b*, and therefore compared with the constitution in which the toner seal member 52 is peeled off in one direction as described in Embodiment 1, a reduction in peeling-off force cannot be expected.

[Constitution of this Embodiment]

Figure 17:
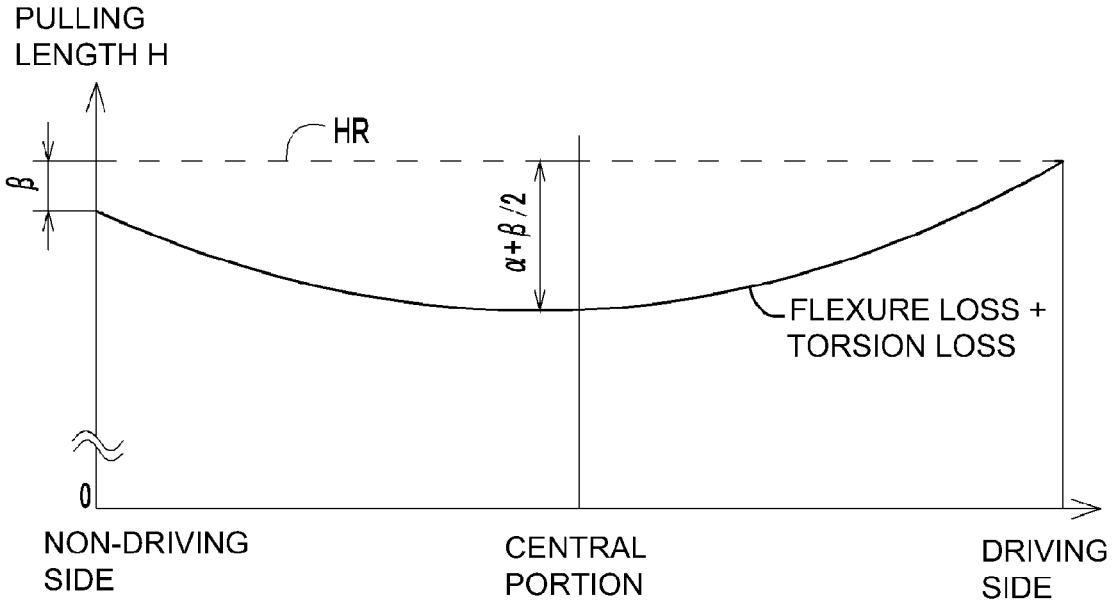
FIG. 17 is a schematic view showing a pulling length of the toner seal member pulled by the rotatable member.

With reference to FIG. 17, a method of cancelling the influences of the torsion and the flexure will be described. FIG. 17 is a graph showing a pulling length in which the toner seal member 52 is pulled by the rotatable member 101. In FIG. 17, the abscissa represents the longitudinal position of the rotatable member 101, in which "NON-DRIVING SIDE" is the position of the non-driving side hole 52*c*L, "CENTRAL PORTION" is the position of the central portion hole 52*c*C, and "DRIVING SIDE" is the position of the driving side hole 52*c*R ((c) of FIG. 8). Further, in FIG. 17, the ordinate represents a pulling length H when the rotatable member 101 winds up the toner seal member 52 (FIG. 8). The pulling length H is 0 at the moment when tension is applied to the toner seal member 52 and means a length in which the rotatable member 101 pulls the toner seal member 52 until the increased tension reaches the limit of the welding strength at the first sealing portion 24*a* in the driving side.

As shown in FIG. 17, on the basis of the driving side, when a driving side pulling length is HR, a positions other than the driving side position, the pulling length is smaller than HR by an amount corresponding to "FLEXURE LOSS+TORSION LOSS". In order to cancel the influences of the torsion and the flexure, in the whole longitudinal region, the pulling length H may only be required to be made equal to the driving side pulling length HR. As a means for making the pulling length equal in the whole longitudinal region, the outer configuration of the rotatable member for winding up the toner seal member 52 is gradually changed along the longitudinal direction. As a result, the tension can reach the limit of the welding strength substantially at the same time in the whole longitudinal region at the first sealing portion 24*a*. This is true for the second sealing portion 24*b*.

The pulling length H at an arbitrary longitudinal position can be represented by a winding-up length M, a flexure loss length LT, an arcuate portion radius r and a rotational angle θ. Further, the winding-up length M can be represented by r×θ, and θ at a position other than the reference position includes a component corresponding to the torsion loss. Further, θ is 0 at the moment when the tension is applied to the toner seal member 52, and is defined as an angle of rotation of the rotatable member until the tension increases and reaches the limit of the welding strength at the first sealing portion 24*a*. That is, the following relationship holds.

$$(\text{Pulling length } H)=(\text{Winding-up length } M(=r\times\theta))-(\text{Torsion loss } LT)$$

Further, the winding-up loss M is r×θ, and a cancelling condition is H=HR, and therefore rθ−LT=HR. By employing the rotatable member having the arcuate portion radium r satisfying this relationship, the influences of the torsion and the flexure can be cancelled, so that the tension can reach the limit of the welding strength substantially simultaneously in the whole longitudinal region.

[Unsealing in One Direction from Driving Side]

Figure 18:
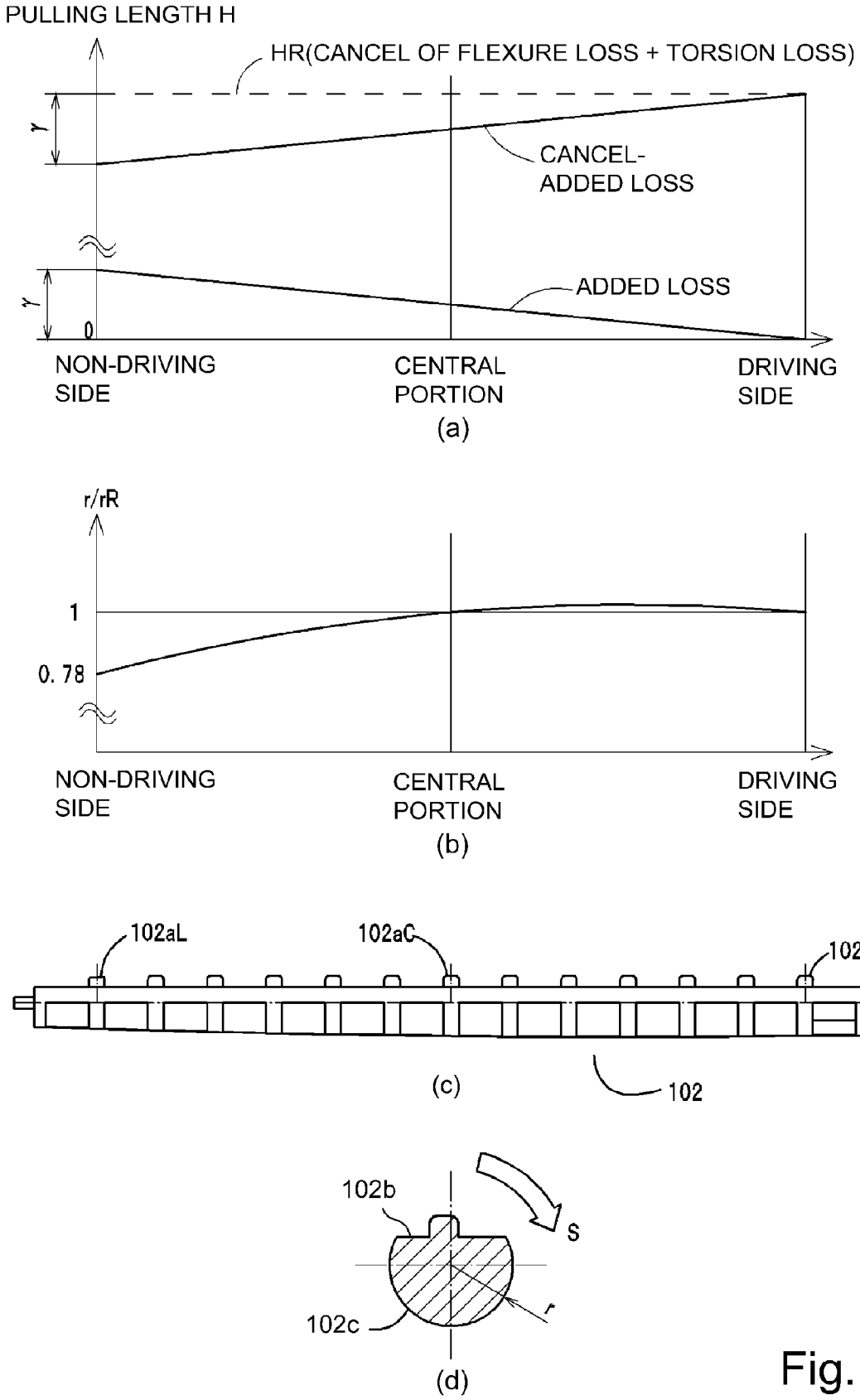
In FIG. 18, (a) to (d) are schematic views for illustrating a rotatable member in Embodiment 2.

With reference to (a) to (d) of FIG. 18, a constitution of the rotatable member in this embodiment for peeling off the toner seal member in one direction from the driving side toward the non-driving side with respect to the longitudinal direction will be described. In FIG. 18, (a) is a graph showing the pulling length in which the toner seal member is pulled by the rotatable member, (b) is a graph for illustrating the arcuate portion radius of the rotatable member in Embodiment 2, (c) is a plan view showing the outer configuration of the rotatable member in Embodiment 2, and (d) is a sectional view of the rotatable member in Embodiment 2.

With reference to (a) of FIG. 18, the pulling length will be described. In order to enable the unsealing in one direction, from a state of "CANCEL OF FLEXURE LOSS+TORSION LOSS" in which the flexure loss and the torsion loss are cancelled, loss may only be required to be intentionally added. The loss to be intentionally added is referred to as added loss, and an added loss length at an arbitrary position is LA (>0). The added loss shows a rectilinear line which monotonically increases from the driving side toward the non-driving side. In the non-driving side, a maximum of the added loss (maximum added loss) is γ. A value obtained by subtracting "ADDED LOSS" from "CANCEL OF FLEXURE LOSS+TORSION LOSS" is represented by "CANCEL−ADDED LOSS".

With reference to (b) to (d) of FIG. 18, the arcuate portion radius r, the contact and the cross section of an arcuate portion 102*c* of a rotatable member 102 in which "CANCEL−ADDED LOSS" is reflected will be described.

The pulling length H by the rotatable member 102 is represented by the following formula.

$$H=M-LT$$

Here, M=r×θ and thus the following formula holds.

$$H=r\times\theta-LT$$

This pulling length equals to "CANCEL−ADDED LOSS", and therefore the following formula holds.

$$H-r\times\theta-LT=HR-LA$$

Accordingly, the following formula holds.

$$r\times\theta=HR-LA+LT$$

Further, when a driving side radius is rR and an angle of rotation in the driving side is θR, HR=rR×θR holds. The maximum torsion loss β is represented by β=aR+HR by using the driving side pulling length HR and a proportionality coefficient a. The maximum flexure loss α is represented by α=cR×HR by using the driving side pulling length HR and a proportionality coefficient c. The maximum added loss γ is represented by γ=eR×HR by using the driving side pulling length HR and a proportionality coefficient e. In this case, a value of r/rR at the arbitrary longitudinal position is the function of aR, cR and eR. Further, from α>β/2, 2cR>aR holds.

Here, as a specific example, when aR=cR=0.1 and eR=0.3, a ratio of the arcuate portion radius r of the arcuate portion 102*c* to the driving side radius rR in arbitrary cross section of the rotatable member 102 can be obtained. This result is shown in (b) of FIG. 18. In the figure, r/rR shows a curve and is 1.0, 1.0 and 0.78 at positions of a driving side projection 102*a*R, a central portion projection 102*a*C and a non-driving side projection 102*a*L, respectively. Here, the driving side projection 102*a*R engages with the driving side hole 52*c*R, the central portion projection 102*a*C engages with the central portion hole 52*c*C, and the non-driving side projection 102*a*L engages with the non-driving side hole 52*a*L ((c) of FIG. 8).

The rotatable member 102 to which the above result is applied is shown in (c) of FIG. 18, and the cross section at the arbitrary position is shown in (d) of FIG. 18. The arcuate portion radius r once increases from the driving side toward the central portion, but is equal to the driving side radius rR at the central portion, and monotonically decreases from the central portion toward the non-driving side. Incidentally, a width of a rectilinear portion 102*b* changes correspondingly to the change in arcuate portion radius r.

When the rotatable member 102 constituted as described above rotates in the arrow S direction, at each of the first and second sealing portions 24*a* and 24*b*, the unsealing can be made in the order of the driving side, the central portion and the non-driving side.

Incidentally, even when the parameters aR, cR and eR are changed, between a central arcuate portion radius rC and a non-driving side arcuate portion radius rL, rL<rC holds. Further, from the central portion toward the non-driving side, the arcuate portion radius monotonically decreases. The pulling length H monotonically decreases from the driving side to the non-driving side, and therefore at each of the first and second sealing portions 24*a* and 24*b*, the tension reaches the limit of the welding strength in the order of the driving side, the central portion and the non-driving side, and therefore the unseal is made in the same order.

[Unsealing in One Direction from Non-Driving Side]

Figure 19:
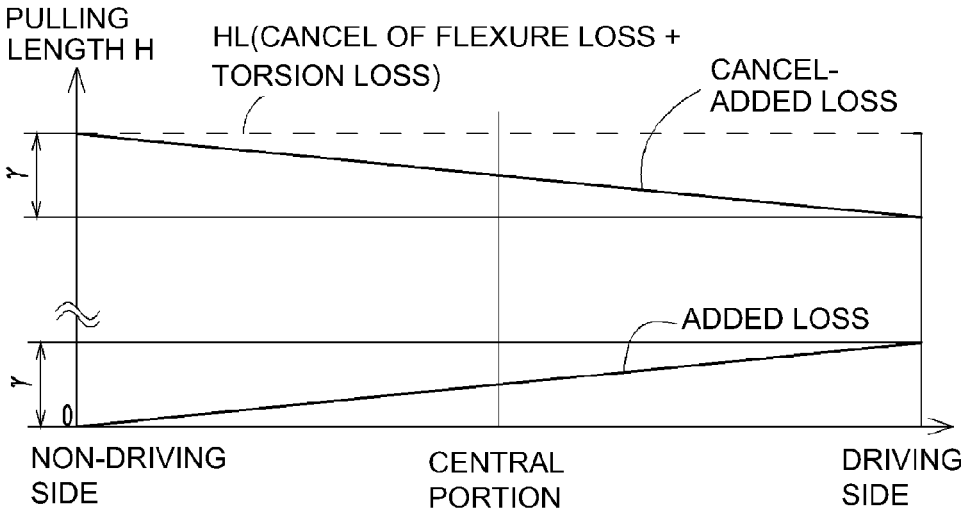
In FIG. 19, (a) to (d) are schematic views for illustrating a rotatable member in modified Embodiment 4.
Figure 19:
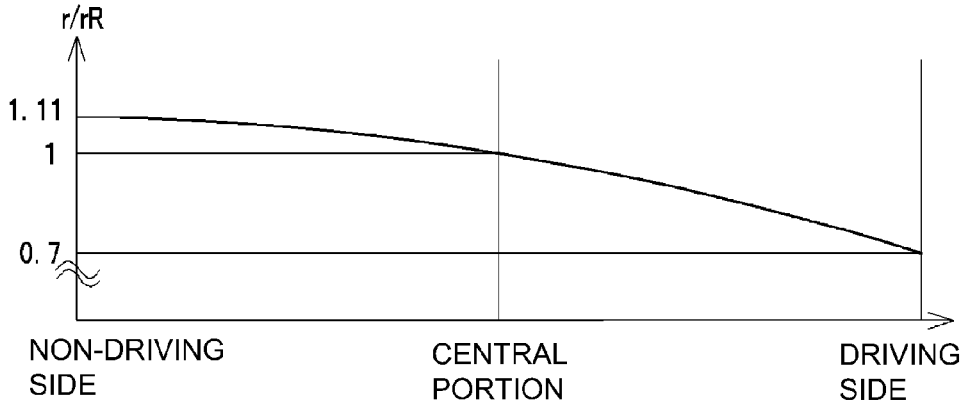
Figure 19:
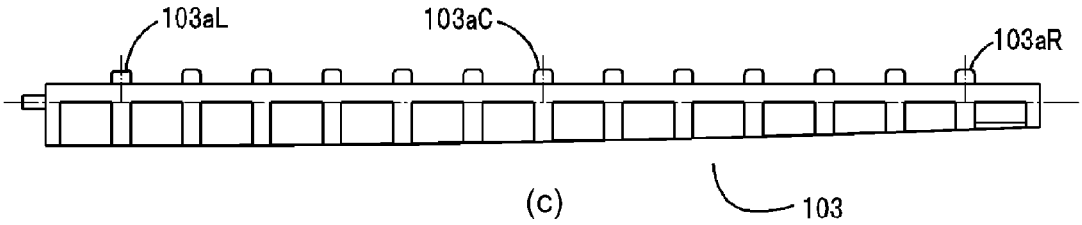
Figure 19:
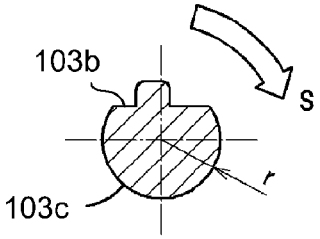

With reference to (a) to (d) of FIG. 19, another constitution (modified Embodiment 4) of the rotatable member for peeling off the toner seal member in one direction from the driving side toward the non-driving side with respect to the longitudinal direction will be described. In FIG. 19, (a) is a graph showing the pulling length in which the toner seal member is pulled by the rotatable member, (b) is a graph for illustrating the arcuate portion radius of the rotatable member in modified Embodiment 4, (c) is a plan view showing the outer configuration of the rotatable member in modified Embodiment 4, and (d) is a sectional view of the rotatable member in modified Embodiment 4.

With reference to (a) of FIG. 19, the pulling length will be described. The added loss shows a rectilinear line which monotonically increases from the non-driving side toward the driving side. In the driving side, a maximum of the added loss (maximum added loss) is γ.

With reference to (b) to (d) of FIG. 19, the arcuate portion radius r, the contact and the cross section of an arcuate portion 103*c* of a rotatable member 103 in which "CANCEL–ADDED LOSS" is reflected will be described.

The pulling length H by the rotatable member 103 is represented by the following formula.

$$H=r\times\theta-LT=HL-LA$$

Accordingly, the following formula holds.

$$r\times\theta=HL-LA+LT$$

In the above formulas, HL is a non-driving side pulling length as a reference pulling length.

Further, when a non-driving side radius of the arcuate portion 103*c* is rL and an angle of rotation in the non-driving side is θL, HL=rL×θL holds. The maximum torsion loss β is represented by β=aL+HL by using the non-driving side pulling length HL and a proportionality coefficient a. The maximum flexure loss α is represented by α=cL×HL by using the non-driving side pulling length HL and a proportionality coefficient c. The maximum added loss γ is represented by γ=eL×HL by using the non-driving side pulling length HL and a proportionality coefficient e. In this case, a value of r/rL at the arbitrary longitudinal position is the function of aL, cL and eL. Further, from α>β/2, 2cL>aL holds.

Here, as a specific example, when aL=cL=0.1 and eL=0.3, a ratio of the arcuate portion radius r of the arcuate portion 102*c* to the non-driving side radius rL in arbitrary cross section of the rotatable member 103 can be obtained. This result is shown in (b) of FIG. 19. In the figure, r/rL shows a curve and is 0.7, 1.0 and 1.11 at positions of a driving side projection 103*a*R, a central portion projection 103*a*C and a non-driving side projection 103*a*L, respectively. Here, the driving side projection 103*a*R engages with the driving side hole 52*c*R, the central portion projection 103*a*C engages with the central portion hole 52*c*C, and the non-driving side projection 103*a*L engages with the non-driving side hole 52*a*L ((c) of FIG. 8).

The rotatable member 103 to which the above result is applied is shown in (c) of FIG. 19, and the cross section at the arbitrary position is shown in (d) of FIG. 19. The arcuate portion radius r monotonically decreases from the non-driving side toward the central portion and then monotonically decreases from the central portion toward the driving side. Incidentally, a width of a rectilinear portion 103*b* changes correspondingly to the change in arcuate portion radius r.

When the rotatable member 103 constituted as described above rotates in the arrow S direction, at each of the first and second sealing portions 24*a* and 24*b*, the unsealing can be made in the order of the non-driving side, the central portion and the driving side.

Incidentally, even when the parameters aL, cL and eL are changed, between a central arcuate portion radius rC and a driving side arcuate portion radius rR, rC<rR holds. Further, from the central portion toward the driving side, the arcuate portion radius monotonically decreases. The pulling length H monotonically decreases from the non-driving side to the driving side, and therefore at each of the first and second sealing portions 24*a* and 24*b*, the tension reaches the limit of the welding strength in the order of the non-driving side, the central portion and the driving side, and therefore the unseal is made in the same order.

As described above, according to this embodiment, even in the case where the rotatable members 102 and 103 cause the flexure and the torsion, by gradually changes the outer configuration of each of the rotatable members, it is possible to peel off the toner seal member from the driving side toward the non-driving side (or from the non-driving side toward the driving side) with respect to the rotational axis direction. As a result, it is possible to reduce an automatic winding-up load for the toner seal member. Thus, it becomes possible to realize downsizing of the motor and the driving system and to employ an inexpensive material, with the result that it is possible to realize downsizing and cost reduction of the electrophotographic image forming apparatus.

Figure 20:
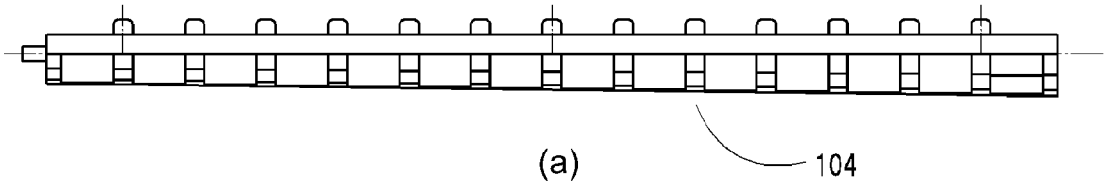
In FIG. 20, (a) and (b) are schematic views for illustrating a rotatable member in modified Embodiment 5.
Figure 20:
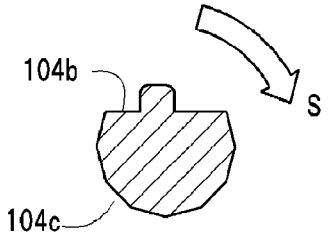

In FIG. 20, (a) and (b) are schematic views showing another example (modified Embodiment 5) of a rotatable member in this embodiment, in which (a) is a plan view showing an outer configuration of the rotatable member, and (b) is a sectional view of the rotatable member. This rotatable member is constituted so as to be removable in one direction from the driving side toward the non-driving side.

As shown in (b) of FIG. 20, a cross section of a rotatable member 104 at an arbitrary longitudinal position is constituted by a rectilinear portion 104*b* and a polygonal portion 104*c*. That is, in Embodiment 2, a contour of the toner seal member winding-up surface in cross section perpendicular to the rotational axis of the rotatable member is the arcuate shape, whereas in modified Embodiment 5, the contour has a polygonal shape. Accordingly, as shown in (a) of FIG. 20, an outer configuration constitution of the rotatable member 104 as a whole has a lightening shape such that a polygonal truncated cone is partly cut away along the longitudinal direction and ribs are provided in the above-described lattice shape.

The cross section of the rotatable member 104 is constituted so as to gradually changes along the longitudinal direction similarly as in Embodiment 2. That is, a radius of a phantom arcuate portion connecting corners of the polygonal portion 104*c* is changed similarly as in Embodiment 2, so that a width of each side of the polygonal portion 104*c* is changed correspondingly to the change in radius. Also a width of the rectilinear portion 104*b* is changed correspondingly to the change in radius of the phantom arcuate portion.

In order to make the unseal from one direction, the pulling length H ("CANCEL–ADDED LOSS") may only be required to be controlled so that the added loss monotonically increases from the driving side toward the non-driving side, and therefore the outer configuration of the rotatable member may be such a polygonal shape.

(Embodiment 3)

An image forming apparatus according to this embodiment will be described with reference to FIG. 21. Incidentally, in this embodiment, a portion different from Embodiments 1 and 2 will be principally described in detail. Materials, shapes and the like are the same as those in Embodiments 1 and 2 unless otherwise specified again. Such the same portions are represented by the same reference numerals or symbols and will be omitted from detailed description.

Figure 21:
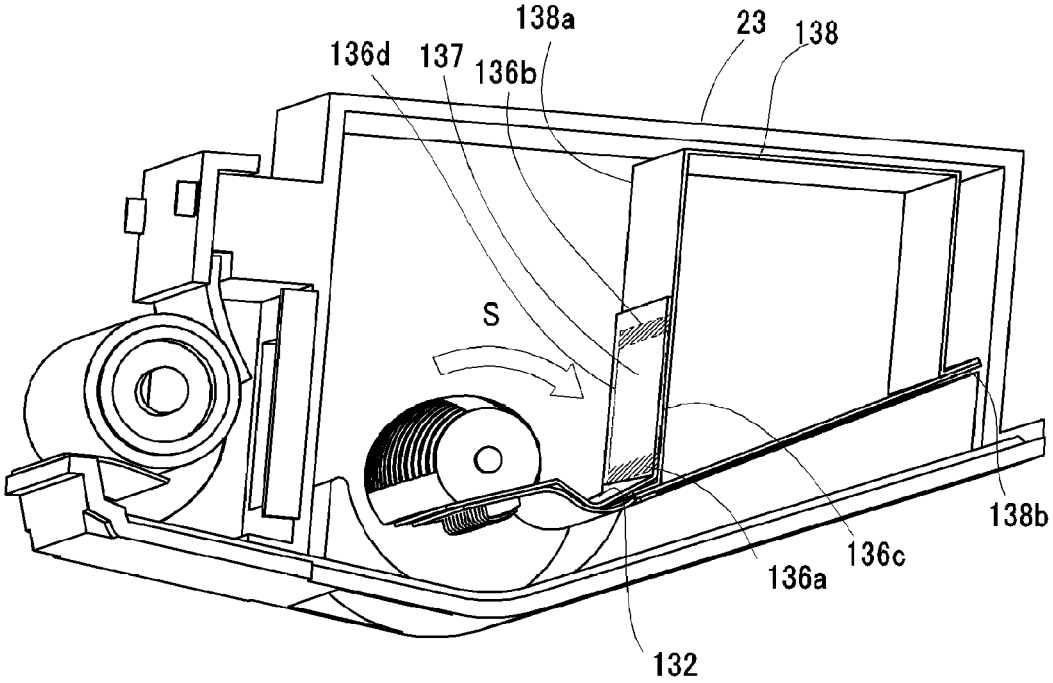
FIG. 21 is a perspective view showing a structure of a developing device unit in Embodiment 3.

FIG. 21 is a perspective view for illustrating structures of the toner accommodating portion, the toner seal member and the toner feeding member in the image forming apparatus in this embodiment. In Embodiments 1 and 2, as a member to be welded with the toner seal member, the developer container 23, having rigidity, capable of constituting the frame is used, but the member to be welded is not limited thereto. As shown in FIG. 21, in this embodiment, a constitution in which another container which is softer and move easily deformable than the developer container is fixed in the developer container and which constitutes the developer accommodating chamber is employed. Specifically, a flexible container 138 formed of a flexible material (such as a thin material of PET, PE or the like) lower in rigidity than a material (such as PS, PPE or ABS) constituting the developer container 23 is fixed, as the toner accommodating portion, in the developer container 23. Further, a toner seal member 132 is welded at sealing portions 136*a* to 136*d* extending along edges of a toner supply opening 137 provided in the container 138. This flexible container 138 is constituted as a unit by bonding first and second frames 138*a* and 138*b* to each other by welding or the like. In this way, the container has the flexibility, the effect of further lowering the maximum load required to peeling off the toner seal member 132 is obtained. Other constitutions are the same as those in Embodiment 1.

(Embodiment 4)

An image forming apparatus according to this embodiment will be described with reference to FIGS. 3, 8 and 22. Incidentally, in this embodiment, a portion different from Embodiment 1 will be principally described in detail. Materials, shapes and the like are the same as those in Embodiment 1 unless otherwise specified again. Such the same portions are represented by the same reference numerals or symbols and will be omitted from detailed description.

Figure 22:
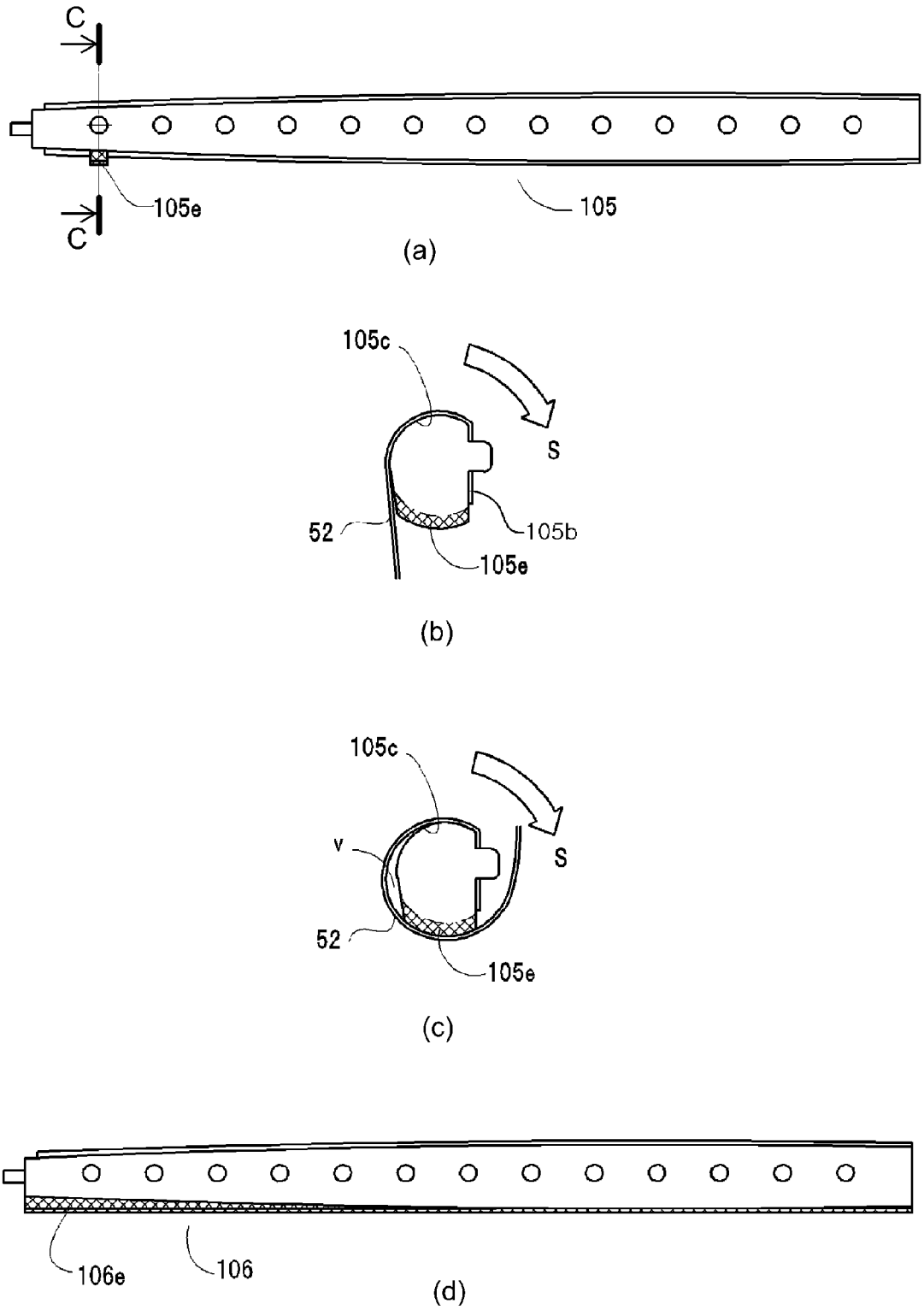
In FIG. 22, (a) to (d) are schematic views for illustrating a rotatable member in Embodiment 4.

In FIG. 22, (a) to (d) are schematic views for illustrating a structure of a rotatable member in this embodiment, in which (a) is a plan view of the rotatable member in this embodiment, (b) and (c) are sectional views of the rotatable member in this embodiment, and (d) is a plan view of the rotatable member in this embodiment. Incidentally, in (a) to (d) of FIG. 22, the feeding sheet 44 is not shown. Further, in (a) to (d) of FIG. 22, a projected portion is indicated as a cross-hatching portion.

In Embodiments 1 to 3, the constitution in which the rotatable member outer configuration is gradually changed so that the unsealing can be made in one direction from the driving side toward the non-driving side or from the non-driving side toward the driving side is described. Here, the toner seal member 52 rotates, after the unsealing of the toner supply opening 27, about the rotation shaft so as to be wound around the outer configuration of the rotatable member 45. The toner T is fed into the toner supplying chamber 28 principally by the feeding sheet 44, but also the toner seal member 52 not a little contributes to the feeding of the toner. However, the outer configuration of a rotatable member 105 is gradually changed, and therefore a winding-up length of the toner seal member 52 varies along the longitudinal direction, with the result that the outer configuration of the toner seal member 52 after the winding-up is inclined with respect to the rotation shaft, so that there is a possibility that supply of the toner T is localized with respect to the longitudinal direction.

Therefore, in this embodiment, as shown in (a) of FIG. 22, the rotatable member 105 is provided, at an outer configuration portion thereof at least in a region in another end side, with a projected portion 105*e* for adjusting a winding-up amount of the toner seal member. The projected portion 105*e* is disposed in the non-driving side where the outer configuration at the longitudinal position is relatively small. Further, as shown in (b) of FIG. 22, the projected portion 105*e* is provided, as an outer peripheral position in cross section, in a downstream region of regions of the arcuate portion 105*c* adjacent to the rectilinear portion 105*b* with respect to the rotational direction, within a range of not adversely affecting a peeling-off operation of the toner seal member 52 from the sealing portion. Further, the projected portion 105*e* is constituted so as to have the same height as the outer configuration in a region where the arcuate portion radius r in the driving side is largest.

In FIG. 22, (b) shows a state, f the toner seal member 52 and the rotatable member 105 at the moment when the toner seal member is wound up and the unsealing at the second sealing portion 24*b* is completed. At this time, the projected portion 105*e* does not contact the toner seal member 52, and therefore does not adversely affect the unsealing operation in one longitudinal direction.

In FIG. 22, (c) shows a state in which the toner seal member 52 is rotated together with the rotatable member 105 after the completion of the unsealing of the toner supply opening. At this time, the projected portion 105*e* contacts the toner seal member 52, so that a spacing v is created between the outer configuration portion (arcuate portion) 105*c* of the rotatable member 105 and the toner seal member 52 in the upstream side of the projected portion 105*e* with respect to the rotational direction, and thus a degree of the winding-up becomes uniform with respect to the longitudinal direction. As a result, it is possible to suppress a phenomenon that the toner seal member 52 is wound about the rotation shaft in an inclined state, so that localization of the supply of the toner T with respect to the develop can be alleviated.

Incidentally, the constitution in which the projected portion 105*e* is provided at a single position close to the longitudinal end portion is described, but may also be provided at a plurality of longitudinal positions. Further, as shown in (d) of FIG. 22 showing a rotatable member 106, a projected portion 106*e* (cross-hatching portion) may also be provided over a whole longitudinal region. As a result, the above-described effect can be further improved.

The Embodiments and modified Embodiments described above can be combined with each other to the possible extent.

The outer configuration shapes of the rotatable members in the Embodiments and modified Embodiments described above are merely examples, and the present invention is not limited thereto. In the above-described Embodiments and modified Embodiments, a constitution in which the toner seal member winding-up surface of the rotatable member extending in non-parallel to the rotation shaft (rotational axis) so that a thickness of the rotatable member in one end side is thicker than a thickness of the rotatable member in the other end side via the central portion. However, it is possible to employ various shapes so long as the shape permits the toner seal member to be removed, as described above, in one direction from the non-driving side (or driving side) toward the driving side (or non-driving side) of the rotatable member.

According to the present invention, it is possible to reduce a sealing member peeling-off load by the rotatable member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 135125/2013 filed Jun. 27, 2013, which is hereby incorporated by reference.

What is claimed is:

1. A developer container comprising:

a developer accommodating chamber, provided with an opening, for accommodating a developer;

a sealing member including end portion sealing portions each for sealing an end portion of the opening and a central portion sealing portion for sealing a central portion of the opening; and a rotatable member, connected with said sealing member, for peeling off said sealing member from the opening by rotation thereof to expose the opening, wherein with respect to a rotational axis direction of said rotatable member, an outer configuration of said rotatable member is different between a sealing-member-connected end thereof and a sealing-member-connected center thereof so that one of the end portion sealing portions is peeled earlier than the central portion sealing portion and so that the central portion is peeled earlier than the other one of the end portion sealing portions.

2. A developer container comprising:

a developer accommodating chamber, provided with an opening, for accommodating a developer;

a sealing member bonded to said developer accommodating container so as to close the opening; and a rotatable member, to which said sealing member is connected, capable of winding up said seal member by peeling off said sealing member from a bonding portion to said developer container by rotation thereof, wherein said rotatable member is constituted so that in a range from an end side to the other end side of a connecting portion to said sealing member with respect to the rotational axis direction, timing from start of winding-up of said sealing member until said sealing member is in a tension state between said rotatable member and the bonding portion is slower with an increasing distance from the end side and so that a speed of an increase in peeling-off amount of said sealing member after said sealing member is in the tension state is slower with an increasing distance from the end side.

3. A developer container according to claim 2, wherein a winding-up amount of said sealing member until said sealing member is in the tension state is the same from the end side to the other end side.

4. A developer container according to claim 1, wherein said sealing member is bonded to a rectangular bonding portion having two sides each extending a direction parallel to a rotation shaft of said rotatable member and two sides each extending in a direction perpendicular to the rotation shaft, and wherein said rotatable member winds up said sealing member so that said sealing member is peeled off gradually in an oblique direction to the rotation shaft from a corner of the rectangular bonding portion toward a diagonal corner thereof.

5. A developer container according to claim 1, wherein said rotatable member has a sealing member connecting surface extending in parallel to a rotation shaft with respect to the rotational axis direction and has a sealing member winding-up surface extending in non-parallel to the rotation shaft with respect to the rotational axis direction so that a thickness of said rotatable member is larger in one end side than in the other end side with respect to a central portion.

6. A developer container according to claim 5, wherein said rotatable member is provided with a plurality for recessed portions at the winding-up surface.

7. A developer container according to claim 5, wherein said rotatable member is provided with a projection, at least in a region in the other end side at the winding-up surface, for adjusting a winding-up amount of said sealing member.

8. A developer container according to claim 5, wherein said rotatable member has a contour in cross section perpendicular to the rotation shaft such that the contour at the winding-up surface has an arcuate shape.

9. A developer container according to claim 5, wherein said rotatable member has a contour in cross section perpendicular to the rotation shaft such that the contour at the winding-up surface has a polygonal shape.

10. A developer container according to claim 1, wherein said rotatable member has a shape such that a sealing member mounting surface which is recessed from a peripheral surface and which extends in parallel to a rotation shaft is provided as apart of a circular truncated cone shape which gradually increases in thickness from the other end side toward one end side.

11. A developer container according to claim 1, wherein said rotatable member has a shape such that one of sides, extending in the rotational axis direction, of a truncated square pyramid shape which gradually increases in thickness from the other end side toward one end side.

12. A developer container according to claim 1, wherein said rotatable member has a shape such that a projected portion projected into a direction perpendicular to the rotational axis direction is provided at a part of a circular column configuration in one end side.

13. A developer container according to claim 1, wherein a rotational driving force is applied to an end of said rotatable member with respect to the rotational axis direction.

14. A developer container according to claim 1, wherein said rotatable member constitutes a feeding member for feeding the developer, accommodated in said developer accommodating chamber, to an outside of said developer accommodating chamber through the opening.

15. A developer container according to claim 1, wherein said rotatable member constitutes a stirring member for stirring the developer accommodated in said developer accommodating chamber.

16. A developer container according to claim 1, wherein said developer accommodating chamber is formed of a flexible material lower in rigidity than a material constituting said developer container, and is provided in a flexible container fixed in said developer container.

17. A developing cartridge detachably mountable to a main assembly of an image forming apparatus, comprising:

a developer container according to claim 1;

a developer carrying member for carrying the developer; and a developer supply chamber, in which said developer carrying member is provided, communicating with said developer accommodating chamber via the opening.

18. A process cartridge detachably mountable to a main assembly of an image forming apparatus, comprising:

a developer container according to claim 1 or a developing cartridge according to claim 17;

a developer carrying member for carrying the developer; and a developer supply chamber, in which said developer carrying member is provided, communicating with said developer accommodating chamber via the opening.

19. An image forming apparatus for forming an image with a developer on a recording material; comprising:

a developer container according to claim 1;

a developer carrying member for carrying the developer; and a developer supply chamber, in which said developer carrying member is provided, communicating with said developer accommodating chamber via the opening.

* * * * *